US007694947B2

(12) United States Patent
Marsh

(10) Patent No.: US 7,694,947 B2
(45) Date of Patent: Apr. 13, 2010

(54) APPARATUS AND METHOD OF ON DEMAND PRINTING, BINDING, AND TRIMMING A PERFECT BOUND BOOK

(75) Inventor: Jeffrey D. Marsh, St. Charles County, MO (US)

(73) Assignee: Perfect Systems, LLC, Foristell, MO (US)

( * ) Notice: Subject to any disclaimer, the term of this patent is extended or adjusted under 35 U.S.C. 154(b) by 309 days.

(21) Appl. No.: 11/359,975

(22) Filed: Feb. 21, 2006

(65) Prior Publication Data

US 2006/0140743 A1 Jun. 29, 2006

Related U.S. Application Data

(63) Continuation of application No. 10/020,266, filed on Dec. 7, 2001, now Pat. No. 7,014,182, which is a continuation-in-part of application No. 09/793,671, filed on Feb. 26, 2001, now Pat. No. 6,443,682, which is a continuation of application No. 09/301,918, filed on Apr. 29, 1999, now Pat. No. 6,193,458.

(60) Provisional application No. 60/254,106, filed on Dec. 8, 2000, provisional application No. 60/281,524, filed on Apr. 4, 2001.

(51) Int. Cl.
*B65H 37/04* (2006.01)

(52) U.S. Cl. ..... 270/58.07; 270/1.01; 270/58.08; 270/58.09

(58) Field of Classification Search ..... 270/1.01, 270/58.07, 58.08, 58.09; 412/1, 2, 3, 4, 16, 412/19, 33
See application file for complete search history.

(56) References Cited

U.S. PATENT DOCUMENTS 1,003,679 A 9/1911 Welch
1,076,726 A 10/1913 Welch (Continued)

FOREIGN PATENT DOCUMENTS

EP 0390734 8/1990

(Continued)

*Primary Examiner*—Gene Crawford
*Assistant Examiner*—Leslie A Nicholson, III
(74) *Attorney, Agent, or Firm*—Polster Lieder Woodruff & Lucchesi, LC

(57) ABSTRACT

A printing and binding apparatus (1) is disclosed which can print on demand, bind, and trim a perfect bound book. The apparatus includes one or more text page printers (110, 200) and a color cover printer (114). The text page printers print the text pages of a book and form the text pages into a book block (BB). The color cover printer (114) prints a cover for the book. The book block and the cover are delivered to a binding station at which the spine (S) of the book block is adhesively bound to the cover. The bound book is then delivered to a trimming station (TS) at which excess margins (are trimmed from the book. A method of printing and binding a perfect bound book on demand is also disclosed.

11 Claims, 20 Drawing Sheets

U.S. PATENT DOCUMENTS 1,088,573 A 2/1914 Heldmann
1,635,165 A 7/1927 Adamsky
1,704,454 A 5/1929 Ackley
1,757,623 A 5/1930 Frazier
2,895,148 A 7/1959 Hildmann
3,093,396 A 6/1963 Segreto
3,532,363 A 10/1970 Abildgaard et al.
3,570,350 A 3/1971 Fogg
3,575,501 A 4/1971 Rosenberg
3,633,727 A 1/1972 Brenner
3,797,362 A 3/1974 Heckman
3,888,150 A 6/1975 Stroud et al.
3,905,531 A 9/1975 Aspinwall
3,925,126 A 12/1975 Leatherman et al.
3,925,926 A 12/1975 Shigeo
3,956,053 A 5/1976 Staats
3,957,287 A 5/1976 Hall et al.
3,973,787 A 8/1976 Staats et al.
3,982,744 A 9/1976 Kraynak et al.
4,075,726 A 2/1978 Korsgaard
4,149,288 A 4/1979 Sendor et al.
4,184,218 A 1/1980 Hawkes
4,289,330 A 9/1981 Wiermanski
4,296,294 A 10/1981 Beckert et al.
4,367,061 A 1/1983 Wiholm
4,420,282 A 12/1983 Axelrod
4,436,469 A 3/1984 Kelly
4,484,501 A 11/1984 Ramcke
4,496,617 A 1/1985 Parker
4,507,037 A 3/1985 Fenimore
4,518,157 A 5/1985 Stobb
4,528,643 A 7/1985 Freeny, Jr.
4,556,353 A * 12/1985 Ehlermann ..... 412/5
4,606,387 A 8/1986 Weislogel et al.
4,715,758 A 12/1987 Stobb
4,839,829 A 6/1989 Freedman
4,863,191 A 9/1989 Termanis
4,922,773 A 5/1990 Ito
4,923,351 A 5/1990 Nishikawa
5,006,396 A 4/1991 VanBortel et al.
5,009,138 A 4/1991 Rettie
5,108,244 A * 4/1992 Bellanca ..... 412/37
5,137,409 A 8/1992 Honegger
5,213,461 A 5/1993 Kalisher
5,240,362 A 8/1993 Nakayama et al.
5,259,285 A 11/1993 Uchida
5,295,775 A 3/1994 Andjelic et al.
5,304,050 A 4/1994 Vismara
5,340,155 A 8/1994 Podosek
5,345,045 A 9/1994 Rohwedder
5,350,268 A 9/1994 Muller
5,354,045 A 10/1994 Boldrini et al.
5,374,050 A 12/1994 Prim
5,417,535 A 5/1995 Andjelic et al.
5,465,213 A * 11/1995 Ross ..... 700/117
5,496,253 A 3/1996 Snellman et al.
5,536,044 A 7/1996 Luhman et al.
5,547,176 A 8/1996 Williams et al.
5,569,012 A 10/1996 Kosasa et al.
5,632,587 A 5/1997 Coyette
5,647,714 A 7/1997 Lundberg
5,647,715 A * 7/1997 Stolz ..... 412/1
5,660,515 A 8/1997 Hartsoe
5,724,075 A 3/1998 Smith
5,820,325 A 10/1998 Hartsoe
5,850,774 A 12/1998 Naldi
5,868,539 A 2/1999 Rathert
5,871,323 A 2/1999 Clark
5,874,812 A 2/1999 Chang
5,904,084 A 5/1999 Weston
5,924,349 A 7/1999 Perazzolo
5,988,620 A * 11/1999 Graushar ..... 270/1.02
6,012,367 A 1/2000 Westra et al.
6,012,840 A 1/2000 Small, IV et al.
6,012,890 A * 1/2000 Celorio Garrido ..... 412/19
6,017,027 A 1/2000 Jaeger
6,017,029 A 1/2000 Bates et al.
6,142,721 A 11/2000 Marsh
6,193,458 B1 2/2001 Marsh
6,206,358 B1 3/2001 Yamaguchi et al.
6,213,703 B1 4/2001 Garrido
6,416,082 B1 7/2002 Gayoso
6,460,843 B1 10/2002 Dim et al.

FOREIGN PATENT DOCUMENTS

JP 97795 5/1986
WO 9938707 8/1999
WO 0003876 1/2000
WO 0066366 11/2000
WO 0245924 6/2002

* cited by examiner

APPARATUS AND METHOD OF ON DEMAND PRINTING, BINDING, AND TRIMMING A PERFECT BOUND BOOK

CROSS REFERENCE TO RELATED APPLICATIONS

This application is a continuation of U.S. patent application Ser. No. 10/020,266, filed Dec. 7, 2001, now U.S. Pat. No. 7,014,182 which is a continuation in part of the U.S. patent application Ser. No. 09/793,671, filed Feb. 26, 2001 (now U.S. Pat. No 6,443,682) which is a continuation of U.S. patent application Ser. No. 09/301,918, filed Apr. 29, 1999 (now U.S. Pat. No. 6,193,458)

U.S. patent application Ser. No. 10/020,266 also claims priority to U.S. Provisional Patent Application No. 60/254,106, filed Dec. 8, 2000, and U.S. Provisional Patent Application No. 60/281,524 filed Apr. 4, 2001

All of said applications are incorporated herein by reference.

BACKGROUND OF THE INVENTION

This invention relates to an apparatus and method of printing on demand, binding and trimming a perfect bound soft cover book. Typically, such soft cover perfect bound books comprise a stacked plurality of text pages (referred to as a book block) having one edge which is referred to as the spine. The cover is of a suitable cover stock that is generally thicker (heavier) than the text pages comprising the book block. The cover has a front portion that overlies the front of the book block, a back portion that overlies the back of the book block, and a center portion spanning across the spine of the book block. A suitable adhesive is applied between the spine of the book block and the inside face of the center portion of the cover. The spine of the book block (i.e., the edges of the text pages along one edge of the book block) is imbedded in the adhesive which, upon curing, securely adheres the pages of the book block to one another and to the center portion of the cover, thereby permitting the book to be opened to any page without the pages coming loose.

In high volume production processes for manufacturing such perfect bound books, the pages of each book block are usually jogged by specially developed machines prior to the application of adhesive so as to insure that the edges of the pages are properly aligned with one another. The adhesive, typically a suitable hot melt adhesive, is then applied to the spine of the book block. The cover, which is usually preprinted, is then folded around the front, spine, and back of the book block and is firmly clamped to the book block proximate the spine during assembly. In this manner, the adhesive is firmly pressed between the spine of the book block and the inner face of the center portion of the cover to properly adhere the cover to the book block while simultaneously adhering the pages to one another.

Typically, such perfect bound books are printed on pages that are somewhat larger than the desired size (i.e., the length and width) of the finished and bound book to be produced. These books, after they are bound, are typically trimmed along three sides to the desired final dimension in a separate trimming machine. Heretofore, such operations were carried out in separate machines that required considerable adjustment to bind books of different sizes and thus were best suited for production runs of many books. In addition, both prior art binding machines and trimming machines were very expensive.

In recent years, book printing has undergone changes as computer technology and laser printers have advanced. This new technology now allows for machines capable printing perfect bound books "on-demand". Such on-demand printed books come in a variety of formats and thicknesses (i.e., the number of pages in the book). Thus, there is a need for an economical printing and binding apparatus and system which is sufficiently flexible to allow on-demand printed books of varying size and thickness (at least within a limited range) to be bound and trimmed, even if books of different formats (size) and thickness must be bound one at a time (i.e., with production binding runs consisting of a single book copy). There is a further need for such a printing and binding apparatus and system where such printing and binding operations are fully automated such that a store clerk or attendant need merely to select a prepared data file stored on a computer and send the file to the automated printing and binding apparatus. Thus, the printing and binding apparatus would then generate the printed pages of the book block and the cover of the book, adhere the cover to the book block, and then trim the same. There is yet a further need for such an apparatus and system that is capable of producing various sizes and formats of perfect bound books without the need for undue experimentation or adjustment of the apparatus to produce such different size books.

SUMMARY OF THE INVENTION

Briefly stated, the printing and binding apparatus of a first embodiment of this invention comprises a book page printer that prints the text pages of the book to be bound and collates the pages to form a book block, and a cover printer that prints the cover of the particular book to be bound. In addition, the first embodiment of the invention comprises a carriage receiving the book block and movable along a workpath.

The carriage of the printing and binding apparatus of the first embodiment is configured to hold the book block with the pages of the book block oriented such that the width dimension of the pages of the book block extends vertically and such that a lengthwise edge of the book block is the lowermost horizontal edge of the book block (this lowermost edge being referred to as the spine of the book block). The workpath preferably has a jogging station, a milling station, an adhesive application station, a clamping station, and optionally a trimming station located therealong. The carriage receives the initially collated pages of the book block from the book page (text page) printer transfer mechanism and loosely holds the loose pages of the book block such that a jogging mechanism may mechanically vibrate the pages so as allow the pages to move relative to one another in a manner such that the edges of the pages constituting the spine of the book block are substantially in the same horizontal plane and such that widthwise edges of the pages are substantially in the same vertical planes.

In operation, the carriage securely grips the jogged pages and transports the book block from the jogging station to the milling station where a suitable tool roughs the lowermost margin of the book block so as to insure that the spine is substantially coplanar and has a good adhering surface. The carriage then transports the book block to the adhesive application station where a suitable adhesive is applied to the spine of the book block. The cover printer prints a book cover in black and white or color and transfers the book cover to the workpath where it is precisely positioned in the binding station of the apparatus relative to the book block being conveyed along the workpath of the apparatus. To increase time efficiency, this is preferably done while the book block is being jogged and collated by the printing and binding apparatus and while the book block receives the application of adhesive along the spine of the book block. At the binding station, the cover of the bound book is positioned such that the center portion of the cover is in register with and is substantially aligned with respect to the spine of the book block with the adhesive disposed between the spine of the book block and the inner face of the cover. The binding station includes a clamp which engages the cover proximate the spine and forcefully compresses the front and back portions of the cover onto the front and back faces of the book block to thereby adhere the center portion of the cover to the spine of the book block, while simultaneously bonding the pages of the book block to one another with the adhesive bonding. The carriage further moves the bound book along the workpath to the trimming station that has a trimming blade capable of trimming the non-spine edges of the bound book. The trimming station has a book positioner which positions a first edge of the book to be trimmed in a desired position with respect to the trimming blade such that when the trimming blade is actuated, a predetermined amount of the cover and the book block along this first edge is trimmed from the bound book. The trimming station further has a book turning mechanism that turns the bound book 90° such that a second edge of the book to be trimmed faces the trimming blade. The book positioner moves the bound book relative to the trimming blade so that upon actuation of the trimming blade, a predetermined amount of the cover and the book block along this second edge is trimmed from the book. The book turning mechanism then turns the bound book another 90° such that a third edge of the bound book to be trimmed faces the trimming blade. Once again, the book positioner moves the bound book relative to the trimming blade so that upon actuation of the trimming blade, a predetermined amount of the cover and the book block along this third edge is trimmed from the book. The trimming process produces a perfect bound book trimmed along three edges to a predetermined size.

While the principal advantages and features of the present invention have been described above, a more complete and thorough understanding and appreciation for the invention may be obtained by referring to the drawings and the detailed description of embodiments of the invention, which follow.

BRIEF DESCRIPTION OF THE DRAWINGS

Corresponding reference characters represent corresponding parts throughout the various views of the drawings.

DETAILED DESCRIPTION OF PREFERRED EMBODIMENTS OF THE INVENTION

Figure 1:
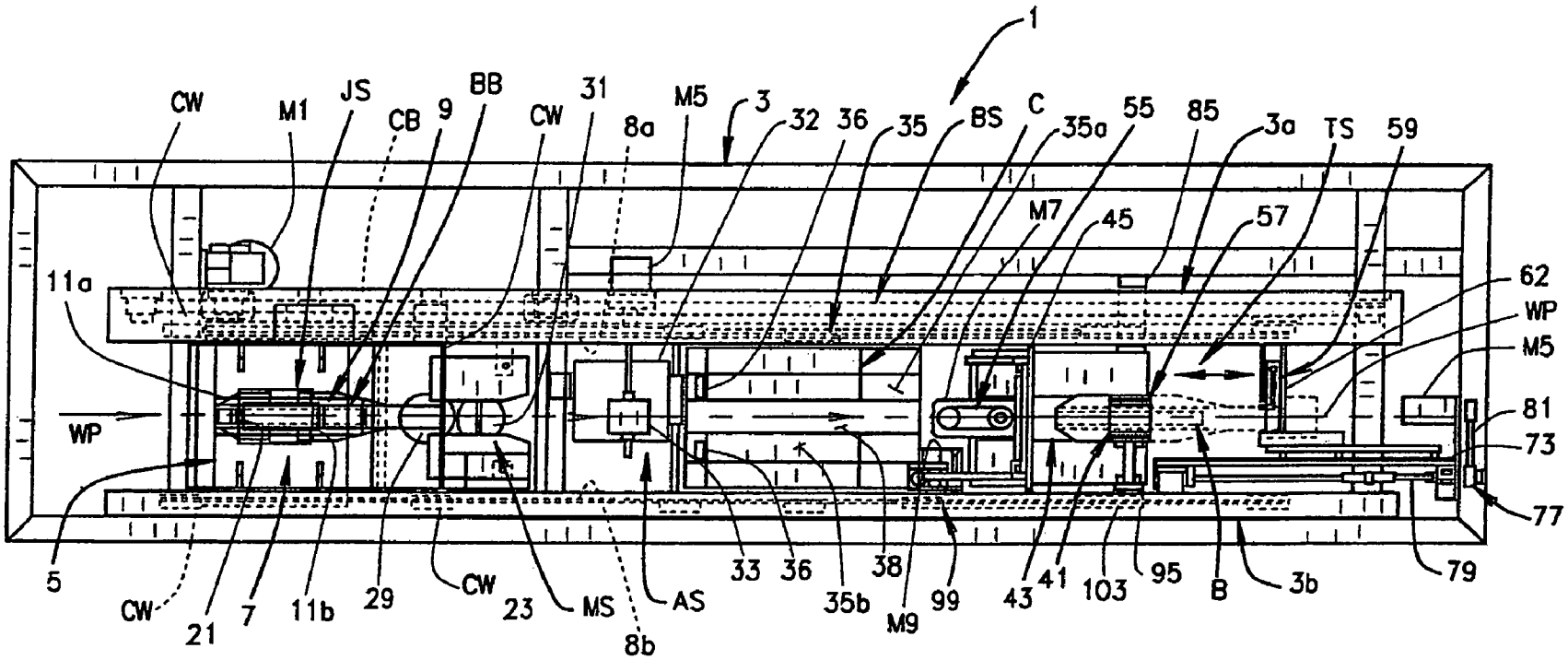
FIG. 1 is top plan view of a first embodiment of a binding and trimming apparatus of the present invention having a book page (text page) printer, a book cover printer, and their respective transfer mechanisms removed to better illustrate the workpath along which a previously printed book block to be bound is transported from a jogging station JS, to a milling station MS, to an adhesive application station AS, to a binding station BS where the book block is bound to a cover, and then to a trimming station TS at which margins of up to three sides of the bound book and cover are trimmed to predetermined dimensions.

Referring now to the drawings, and in particular to FIGS. 1-9, a book binding and trimming apparatus, generally as described in my U.S. Pat. No. 6,193,458, is shown. It will be understood that this last-mentioned U.S. Pat. No. 6,193,458 is herein incorporated by reference. However, to better understand the construction and operation of the on demand book printing, binding and trimming apparatus of this invention, certain key parts of the above-noted book binding and trimming apparatus will be herein described. The term "on demand" book printing is typically understood to mean that a book is printed in response to an order for the book being placed. Thus, by printing a book on demand, the book can be supplied in a short time and the book need not be kept in inventory. In such "on demand" print orders, only a single copy of a book may be ordered or a short press run of the book may be ordered. While the size of a short press run may be arbitrary, as used herein a short press run typically includes a number of copies of a book that is less that would typically be needed to economically justify printing the book by conventional methods, such as by using off set printing.

As shown in FIG. 1, a portion of a first embodiment of a printing and binding apparatus of this invention is indicated by reference character 1. Additional component parts of the first embodiment, a book page printer and its book block transfer mechanism, as well as a color cover printer and its cover transfer mechanism are not shown in FIG. 1 in order to provide an unobstructed view of the top of the binding and trimming apparatus. The book page printer 110 and its transfer mechanism 112 and the book cover printer 114 and its transfer mechanism or conveyor 116 are shown in their relative positions in FIG. 14, which is a view of the apparatus similar to FIG. 1. In the illustrated embodiment of the apparatus, the book page printer 110 is a QMS4032 black and white book body printer and the book cover printer 114 is a QMS330EX color laser printer. However, these are only two examples of printers that could be employed with the apparatus and other printers may alternatively be employed. In fact, because the manufacturers of such printers are constantly introducing new models with better performance and capabilities, it will be understood that such newly introduced printers by any manufacturer may be used with or even retrofitted to the on demand book printing, binding and trimming apparatus of the present invention. The printers and their transfer mechanisms as shown in the drawings will be described in greater detail below.

Figure 13:
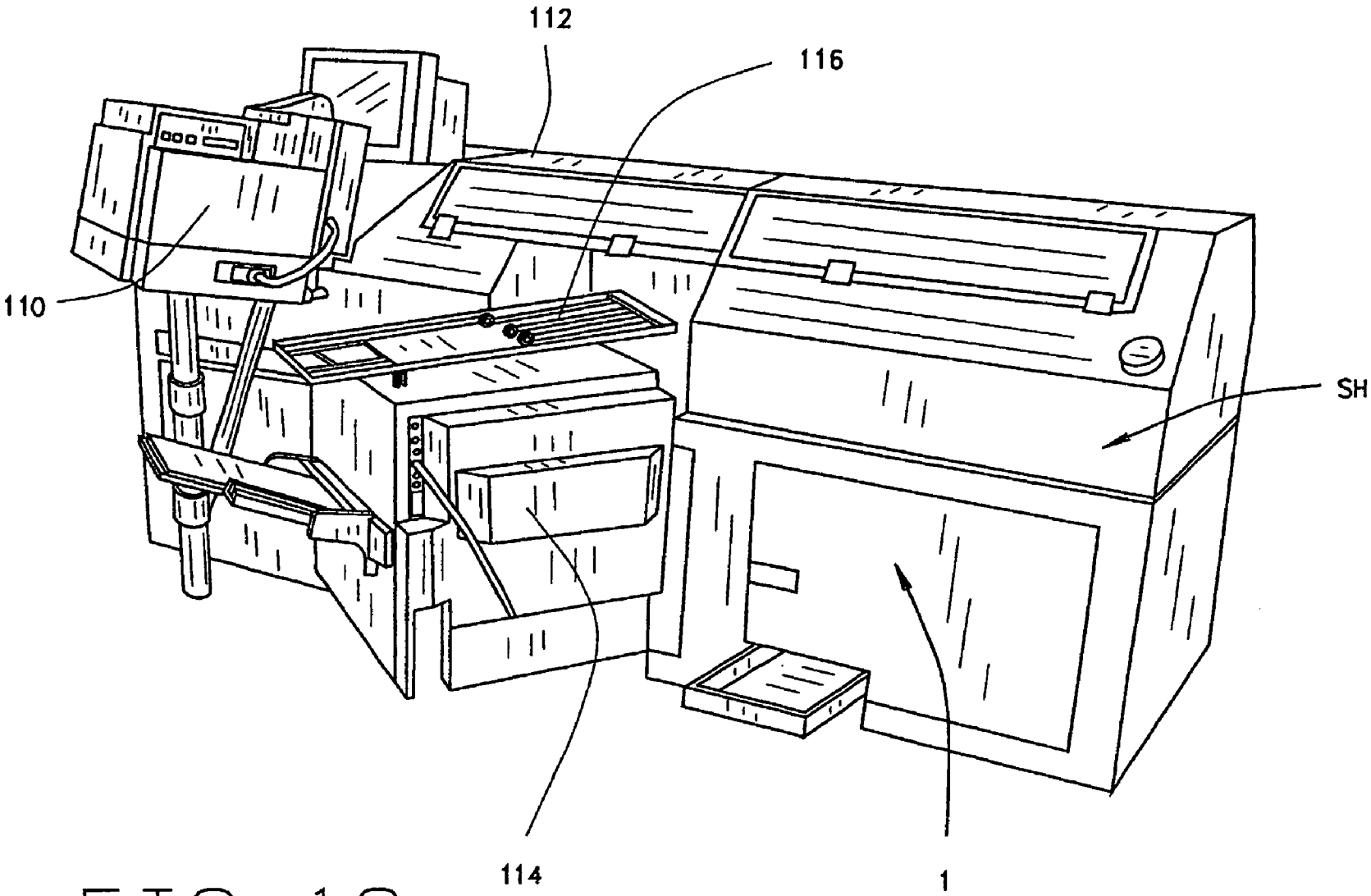
FIG. 13 is a perspective view of the on demand book printing and binding apparatus of FIG. 1 incorporating the book page printer, the book cover printer, their respective transfer mechanisms, and the binding and trimming apparatus shown in FIGS. 1-9 housed within a cabinet.

The printing and binding apparatus 1 has a frame 3 made of welded square steel tubes. The frame 3 has a pair of spaced horizontal frame rails 3*a*, 3*b* extending substantially the length of the apparatus 1. A metal cover or shroud SH may be secured to the frame 3 and is shown in FIG. 13. The shroud has been omitted from the other drawing figures for the sake of clarity.

Figure 3:
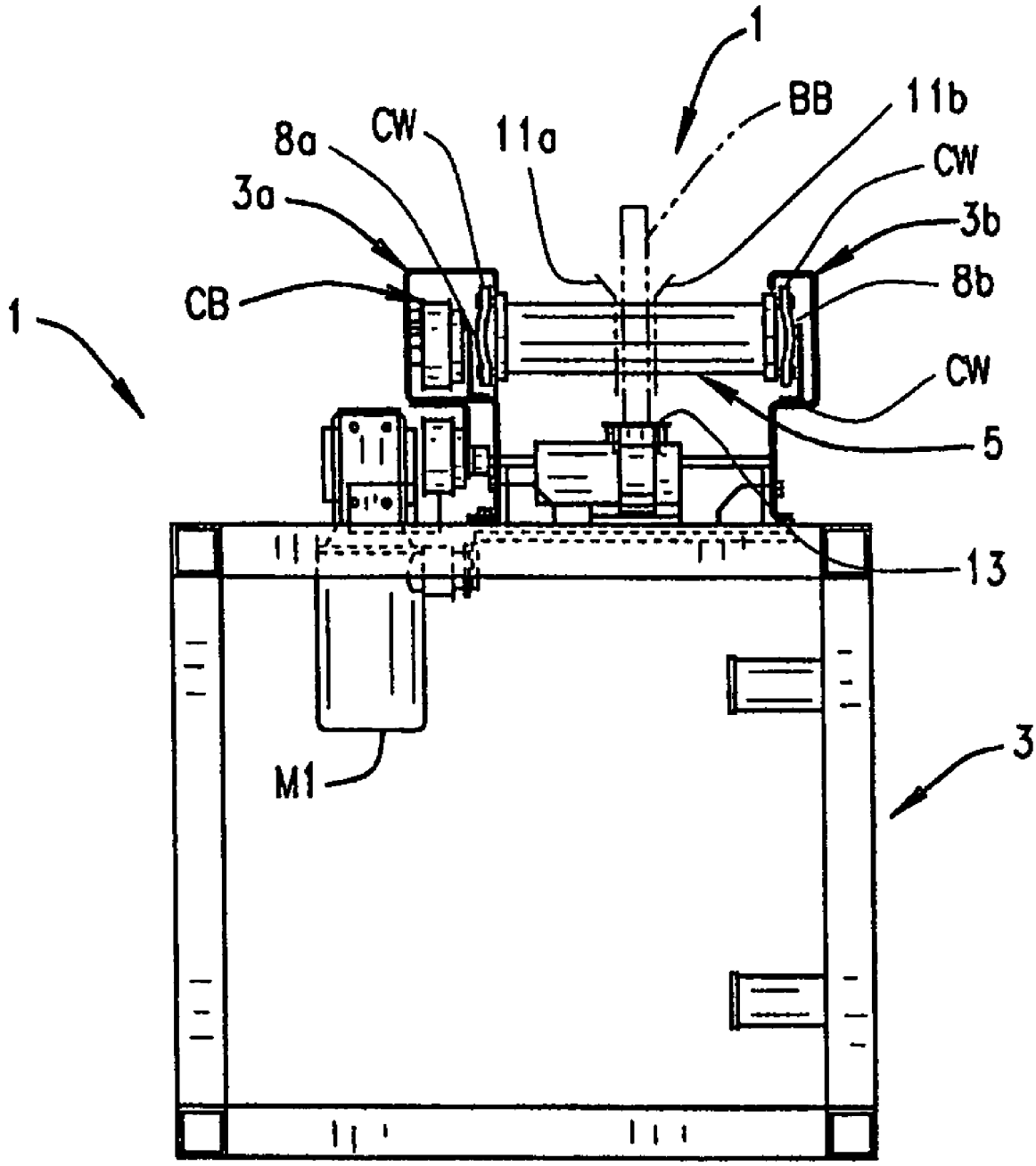
FIG. 3 is a left end elevation view taken along line 3-3 of FIG. 2.
Figure 4:
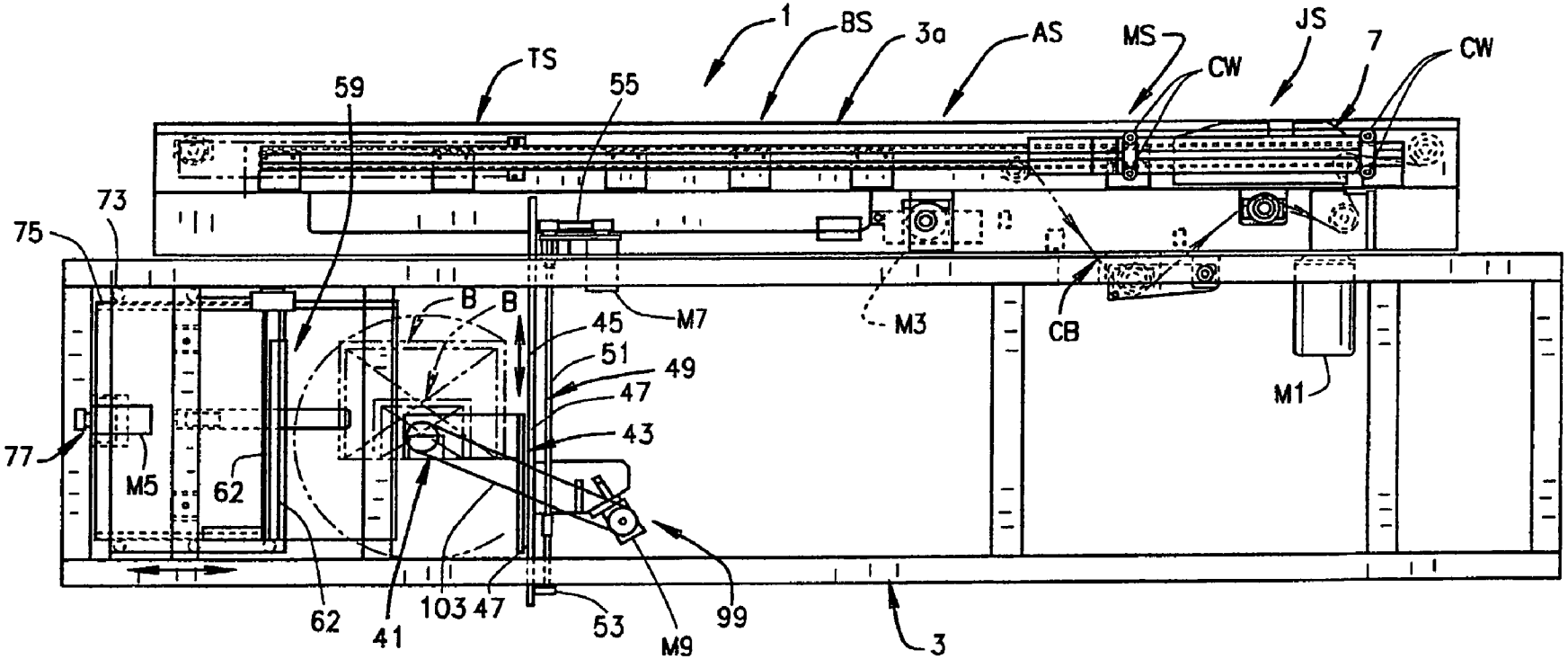
FIG. 4 is a rear side elevation view of the apparatus shown in FIG. 1.
Figure 12:
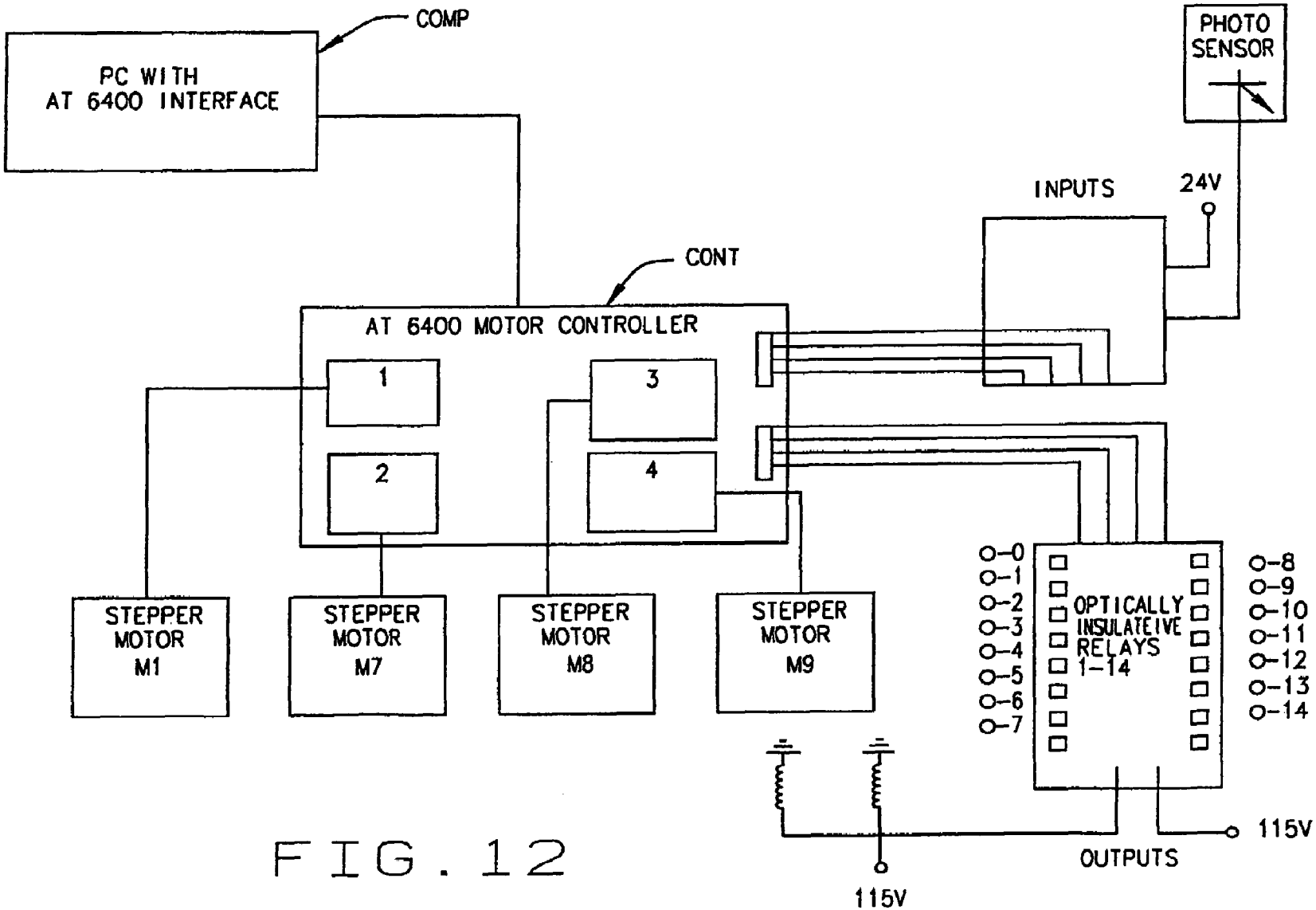
FIG. 12 is a schematic representation of the electrical system of the apparatus.

A conveyor 5 is provided between the frame rails 3*a*, 3*b* for transporting or conveying a book block BB along a workpath WP, as will be described hereinafter. The conveyor 5 includes a carriage 7 movable in a horizontal direction on carriage wheels CW which bear on carriage rails 8*a*, 8*b* that are each mounted to one of the respective frame rails 3*a*, 3*b*, as best shown in FIG. 3. The carriage is power driven along the carriage rails by means of a conveyor stepper motor M1 that drives the carriage via a toothed timing belt and pulley arrangement, as indicated at CB. As best shown in FIG. 4, one end of the timing belt is attached to one end of the carriage 7 and the belt is trained around a drive pulley on the motor M1 and around other pulleys that are journalled to the frame 3 to the other end of the belt which is attached to the other end of the carriage. Preferably, the conveyor motor M1 is a stepper motor driven by a control system CONT 1, as will be hereinafter described and which is shown in FIG. 12, so that the position of the carriage (and hence the book block carried thereby) is accurately known (i.e., to within about 0.005 inches) with respect to a reference surface of the carriage 7. In this manner, the position of the book block is accurately known by the control system CONT 1 as the book block is carried along the workpath where it is bound and trimmed, as will be hereinafter discussed in detail. In this manner, upon energization and de-energization of the motor M1 under the control of the control system CONT 1, the carriage may be accurately stopped at any position or work station along the workpath WP to accurately position the book block at a desired location. When the carriage is at the end of the workpath, the motor M1 can be driven in reverse so as to move the carriage 7 in a reverse direction along the conveyor so as to return the carriage to its starting position where it can then receive the next book block to be bound. In a variant embodiment, the carriage can be advanced past the trimmer station to a second printing station where the carriage receives a second book block prior to the carriage being driven in reverse to return it to a starting position from which the second book block can be bound and trimmed.

Figure 10:
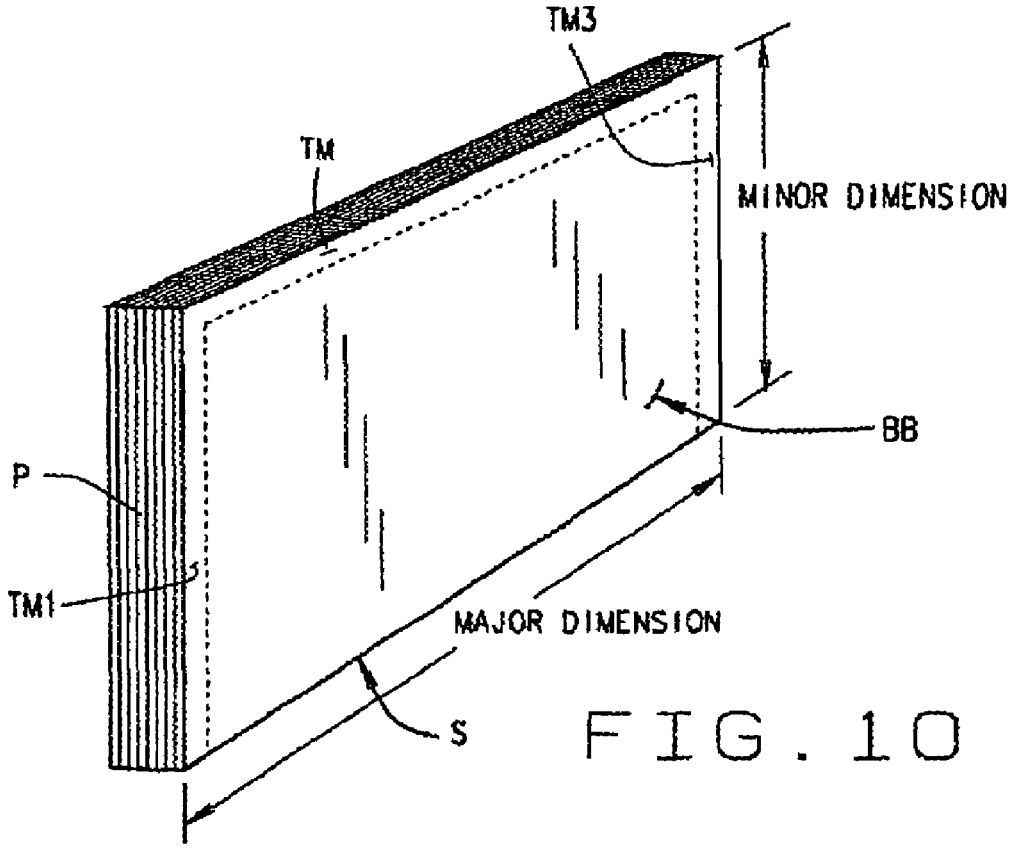
FIG. 10 is a perspective view of a book block.

As shown in FIG. 10, each book block BB comprises a plurality of pages P, which generally constitute the text pages of a book to be bound. The number of pages making up the book block may range between a minimum number and a maximum number of pages, depending on the range of binding thicknesses to be accommodated by the binding and trimming apparatus 1. In the first embodiment of the invention, the thickness of the book block BB ranges from about ¼ inch (or less) to about 1½ inches (or more). This thickness range may accommodate books from about 25 pages up to about 1000 pages (or more), depending on the thickness of the paper used. The minimum thickness of books to be bound by the apparatus 1 is generally dependent on the minimum thickness of the book block capable of being adhesive bound to a cover. Generally, book blocks with less than about 25 pages are not perfect bound, but in theory, a book with even a single page could be bound by other embodiments of the present invention.

Figure 2:
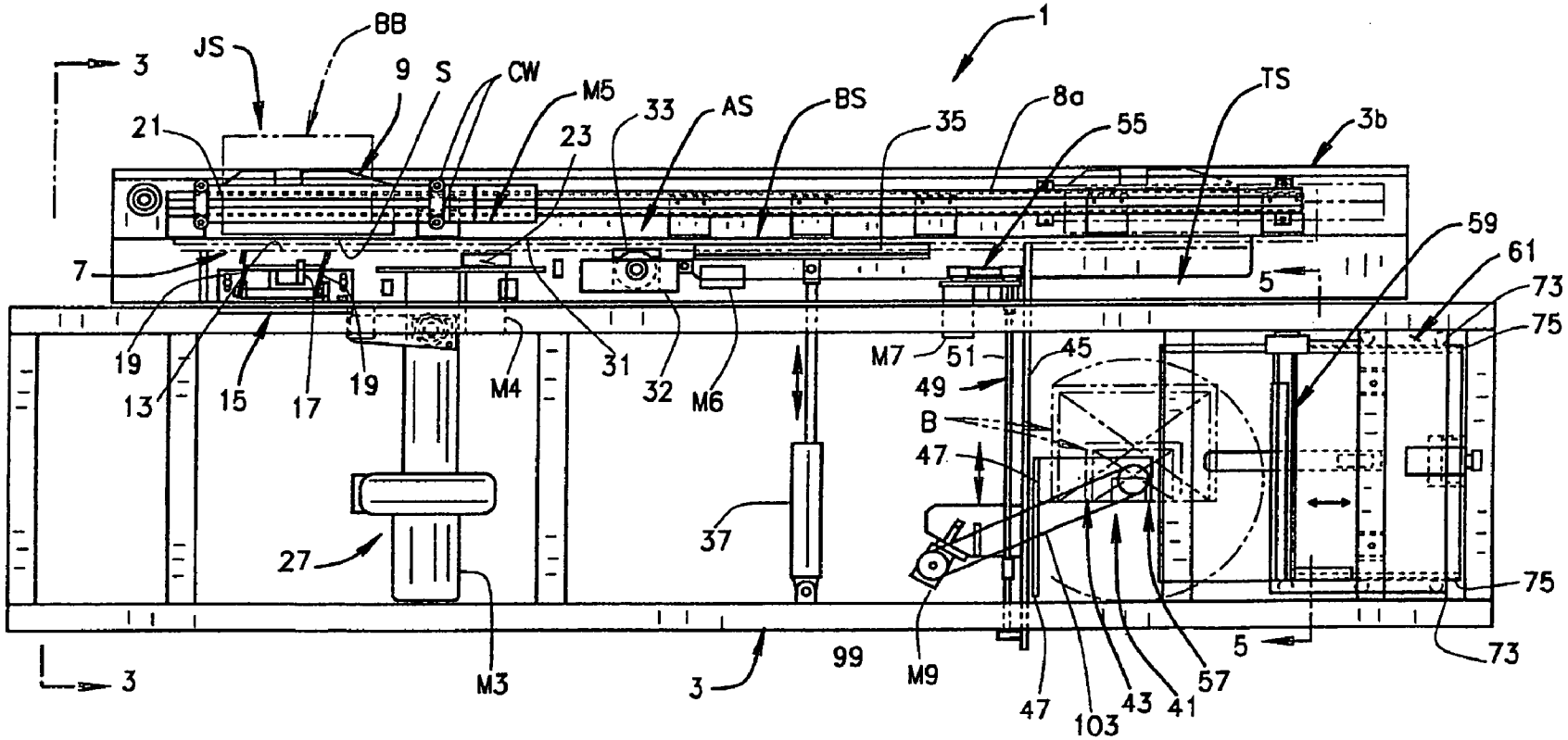
FIG. 2 is a front side elevation view of the embodiment of the binding and trimming apparatus of FIG. 1.

Typically, the pages P of the book block BB are duplex printed on both their front and back faces and are rectangular in shape, having a widthwise dimension and a lengthwise dimension. The pages may, for example, range between a 5×7 inch rectangular format and a 8½×11 inch rectangular format, or any number of rectangular formats within the above range. Of course, it should be understood that other formats may be accommodated by adjusting the size of the printing and binding apparatus. The printing and binding apparatus 1 of the first embodiment of the present invention automatically accommodates any book size within the ranges of sizes thicknesses (i.e., number of pages), as is discussed below. One edge of the book block BB is referred to as the spine S of the book block. As contemplated, the spine of the book block corresponds to the lowermost horizontal edge of the book block (which is a lengthwise (major) rectangular dimension of the pages of the book block) when the book block BB is placed in the carriage of the printing and binding apparatus 1, as shown in FIGS. 1 and 2. While the book block BB is shown to have its longest or major dimension (i.e., its length) as the spine of the book to be bound, those skilled in the art will recognize that the shorter (minor) width of the book block may be used as the spine S instead.

Figure 14:
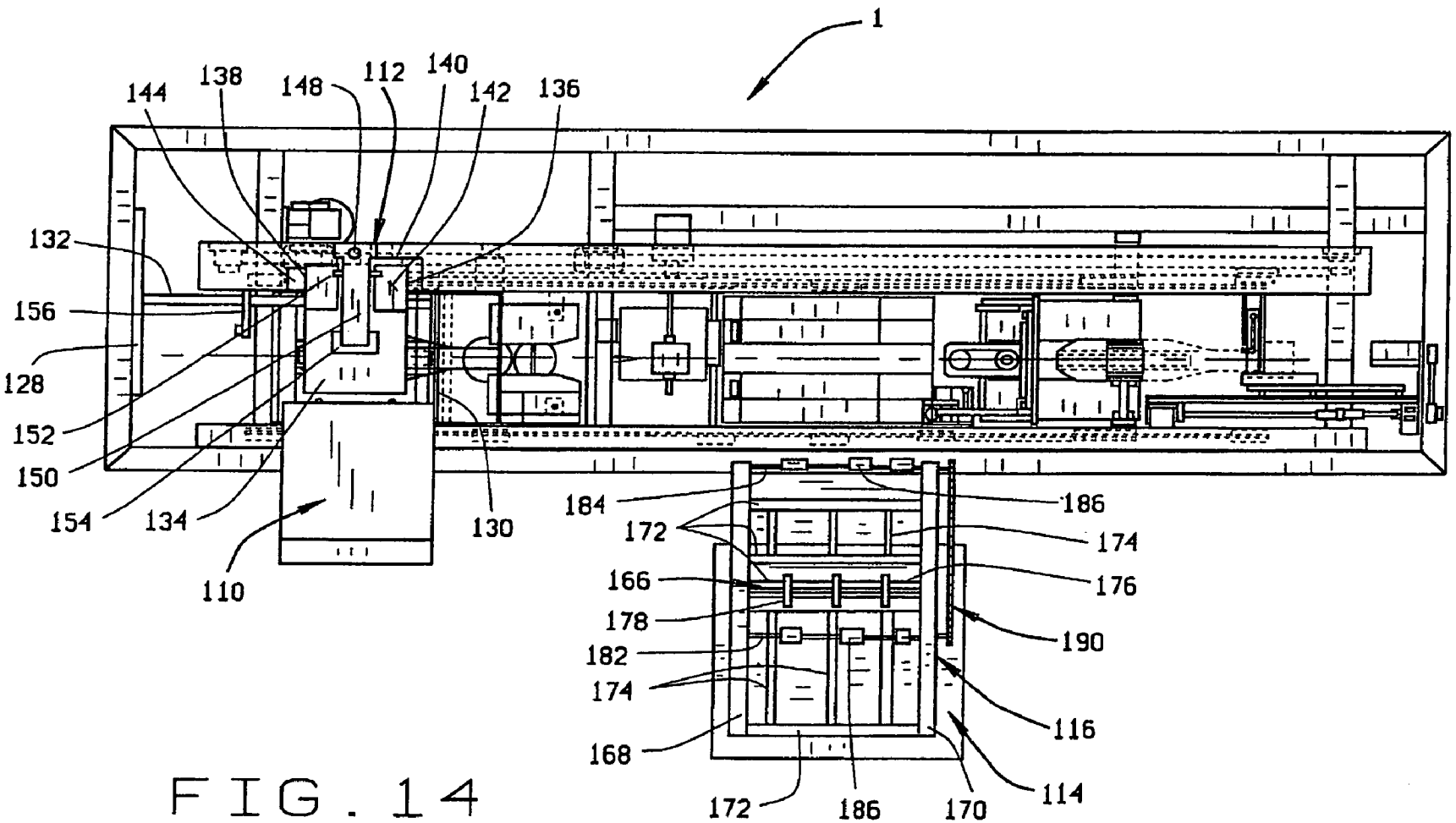
FIG. 14 is a top plan view of the printing and binding apparatus of the present invention with the book page printer and its transfer mechanism and the book cover printer and its transfer mechanism shown in their relative positions with the cover shown in FIG. 13 removed.
Figure 15:
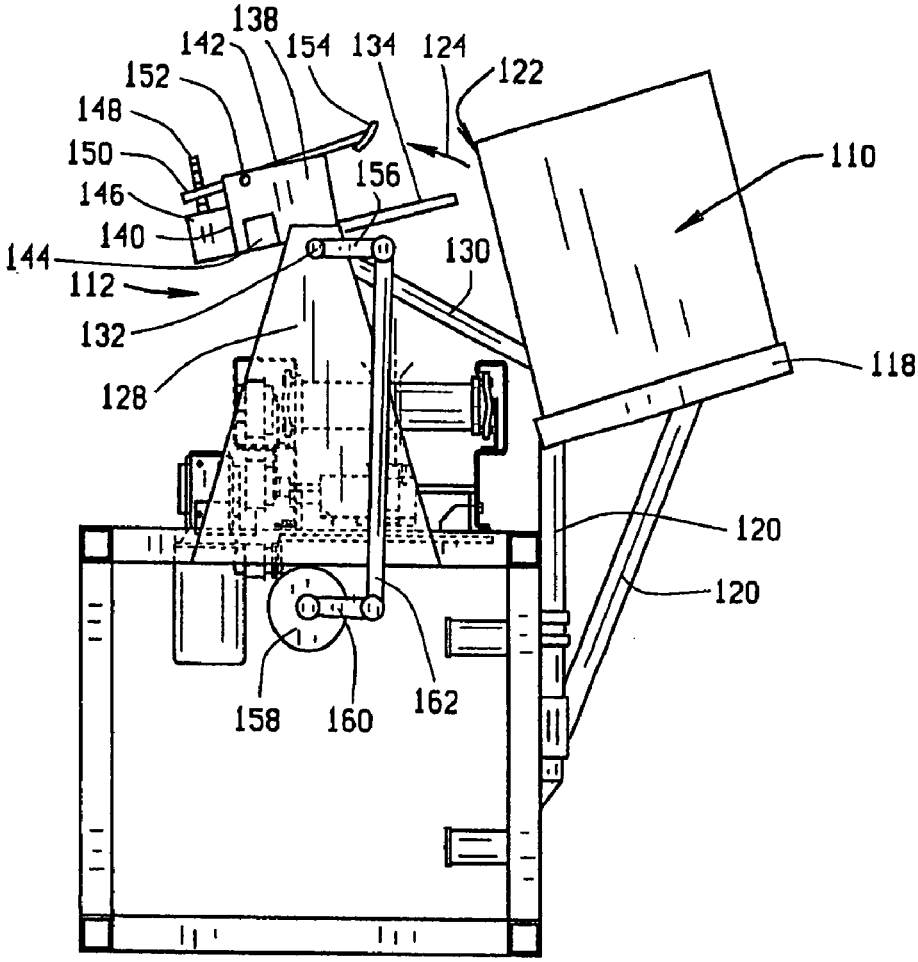
FIG. 15 is a left end elevation view similar to that of FIG. 3 but showing the book page printer, a collator tray for receiving text pages ejected by the book page printer, and its transfer mechanism.
Figure 17:
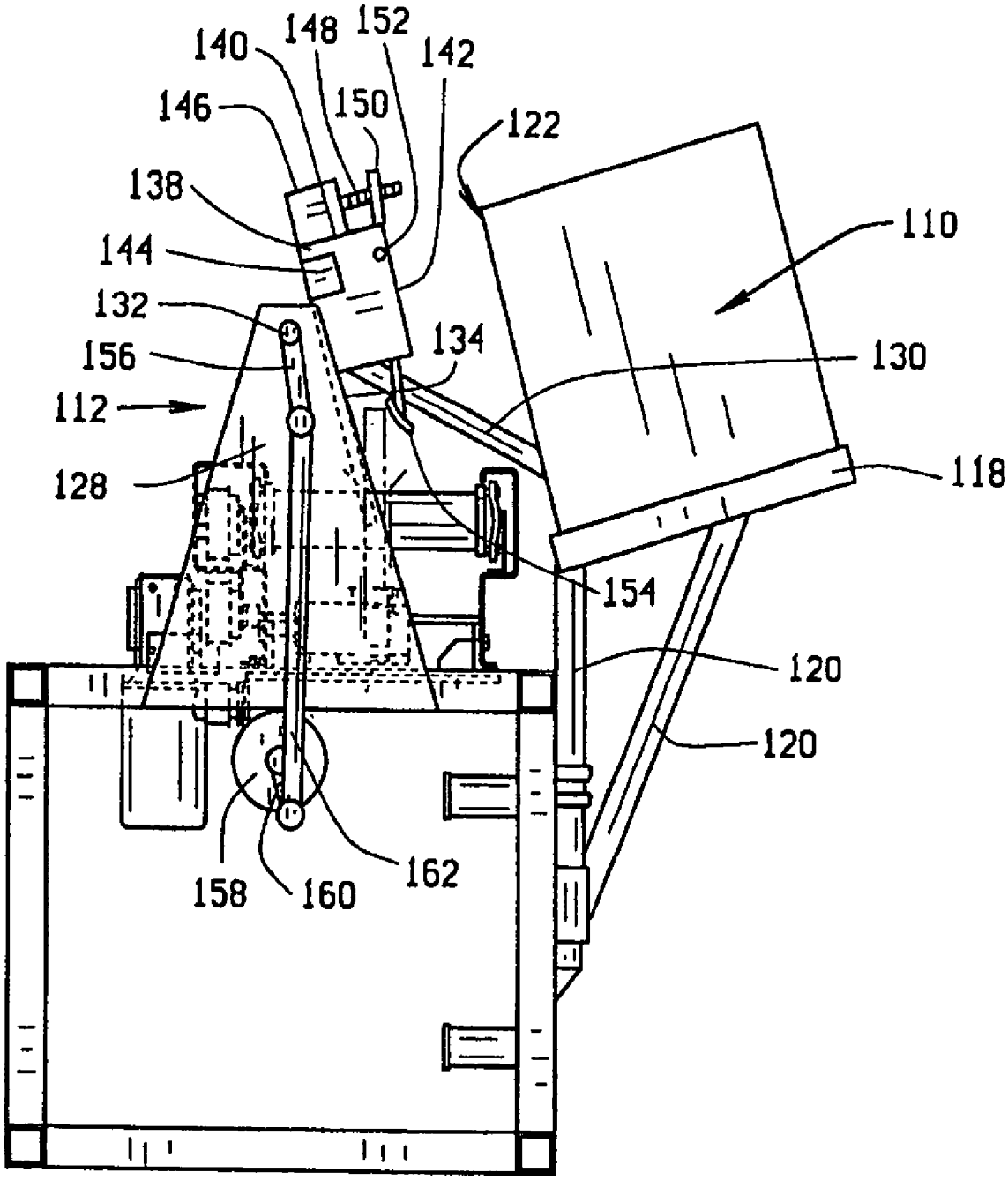
FIG. 17 is a view similar to that of FIG. 15 but showing the book page printer transfer mechanism in its ejection position loading a book block into the carriage of the printing and binding apparatus.

As seen in FIGS. 13, 14, 15, and 17, the first book page (text page) printer 110 is integrated into the book printing and binding apparatus 1 adjacent the jogging station JS. The book page printer 110 is supported adjacent the apparatus by a support platform 118 that is attached to the tubular frame of the apparatus by a vertically hinged support 120. The support is hinged such that the printer can be swung away from its operating position when the printing and binding apparatus requires maintenance. As best seen in FIGS. 15 and 17, the printer platform 118 supports the book page printer 110 at an angled orientation relative to the apparatus. The page ejection slot 122 of the printer is positioned adjacent the apparatus 1 where a printed page of a book being printed by the book page printer 110 will be ejected from the printer slot 122 over the apparatus jogging station JS. The arrow 124 indicates the direction in which printed pages are ejected from the book page printer slot 122. The operation of the book page printer 110, including the pages of the book to be printed, is controlled by the apparatus computer control system CONT 1 with which the book page printer 110 communicates.

Figure 16:
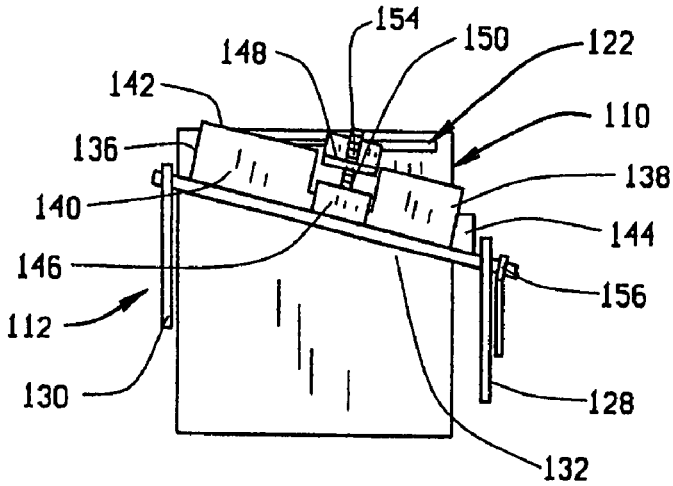
FIG. 16 is a partial view of the transfer mechanism of the book page printer viewed from the left in FIG. 15.

Positioned adjacent the book page printer 110 and over the jogging station JS of the apparatus 1 is the book page printer transfer mechanism 112. The page transfer mechanism 112 is supported over the jogging station JS by a support panel 128 that projects upwardly from the frame 3 of the apparatus 1 at the left hand end of the apparatus as viewed in FIG. 14 and by a support rod 130 that projects outwardly over the jogging station JS from the printer hinge support 120. A shaft 132 is mounted for rotation to the support panel 128 and to the support rod 130 and projects over the jogging station JS. As best seen in FIG. 16, the shaft 132 is angled slightly such that the end of the shaft closest to the left hand end of the apparatus 1, as viewed in FIG. 14, will be slightly lower than the opposite end of the shaft. Mounted on the shaft 132 for rotation therewith is a rectangular collator tray 134. The tray 134 projects out to a position adjacent the page ejection slot 122 of the book page printer 110 where it will receive printed pages ejected from the printer. As best seen in FIG. 15, the tray 134 on the shaft 132 angles downwardly away from the book page printer 110 and is also angled downwardly toward the left hand end of the apparatus as shown in FIG. 14. Mounted at the back of the tray 134 is a box shaped bin having first 136 and second 138 side walls, a rear wall 140, and a top wall 142. The bin receives pages ejected from the page printer 110 and holds the pages on the tray 134 in the initial formation of the book block. A vibrating mechanism 144 is mounted on the second side wall 138 of the bin. Operation of the vibrating mechanism 144, which is controlled by the control system CONT 1, provides an initial jogging and collating of the printed pages of the book block on the tray 134 toward the back wall 140 and the second side wall 138 of the transfer mechanism 112 due to the angled orientation of the shaft 132 and the tray 134 on the shaft.

Mounted on the back wall 140 of the tray 134 is a small reversible, direct current clamping mechanism motor 146. The clamping mechanism motor 146 is selectively controlled by the control system CONT 1 to rotate a screw shaft 148 of the motor in opposite directions. The screw shaft 148 is threaded into a clamping arm 150 at one end of the arm. The arm 150 is mounted by a pivot pin 152 connection to the top wall 142 of the tray bin. The arm has a clamping pad 154 at an opposite end of the arm from the screw shaft 148. Rotation of the screwshaft 148 by the clamping mechanism motor 146 in one direction will cause the arm to pivot about its pivot pin 152, thereby allowing the clamping pad 154 to clamp down on the book block that has been initially collated in the bin of the transfer mechanism 112. Rotation of the screwshaft 148 in the opposite direction will cause the clamping pad 154 to pivot away from the book block, thereby releasing the book block. Contact switches (not shown) are mounted on the clamping arm to produce signals that indicate when a book block is clamped securely by the arm and when the arm is moved to a position to release a book block.

A shaft arm 156 is secured to the transfer tray shaft 132 and projects outwardly a short distance from the shaft. An alternating current transfer mechanism motor 158 is mounted to the frame 3 of the apparatus 1 as shown in FIGS. 15 and 17 and has a motor arm 160 that is secured to the motor shaft and that projects outwardly from the motor shaft. The shaft arm 156 and the motor arm 160 are interconnected by a connecting rod 162 that is mounted to the two arms at its opposite ends by pivot connections. Selective operation of the transfer mechanism motor 158 will cause its shaft, the motor arm 160, and consequently the shaft arm 156 to move through an arc segment which causes the tray 134 to pivot between a printed page receiving position shown in FIG. 15 and a book block depositing position shown in FIG. 17. The motor arm 160 is preferably shorter than the shaft arm 156 such that the tray 134 will move from the page receiving position, to the book block depositing position, and back to the page receiving position simply by rotating the motor arm 160 through a 360° rotation. This allows the transfer mechanism motor 158 to be a simple, non-reversible motor.

In operation, the tray 134 of the book page printer transfer mechanism 112 is first positioned in its page receiving position shown in FIG. 15 by operation of the transfer mechanism motor 160 that is controlled by the control system CONT 1. Pages printed by the book page printer 110 are ejected from the printer slot 122 and are collected on the tray 134. Operation of the bin vibrating mechanism 144 causes the printed pages to be initially jogged and collated as they are collected into the corner of the tray defined by the back wall 140 and the second side wall 138 of the bin. When the entire book block has been printed and initially collated on the tray 134, the clamping mechanism motor 146 is operated causing the clamping arm 150 to close down on the book block with the clamping pad 154 of the arm securely holding the printed book block on the tray. The transfer mechanism motor 160 is then operated causing the tray to move to its book block depositing position shown in FIG. 17. In this position, the clamping mechanism motor 146 is operated causing the clamping arm 150 to open and release the book block from the tray 134 such that the book block will fall into the carriage 7 that holds the book block during further steps in the printing and binding process of the book.

Figure 11:
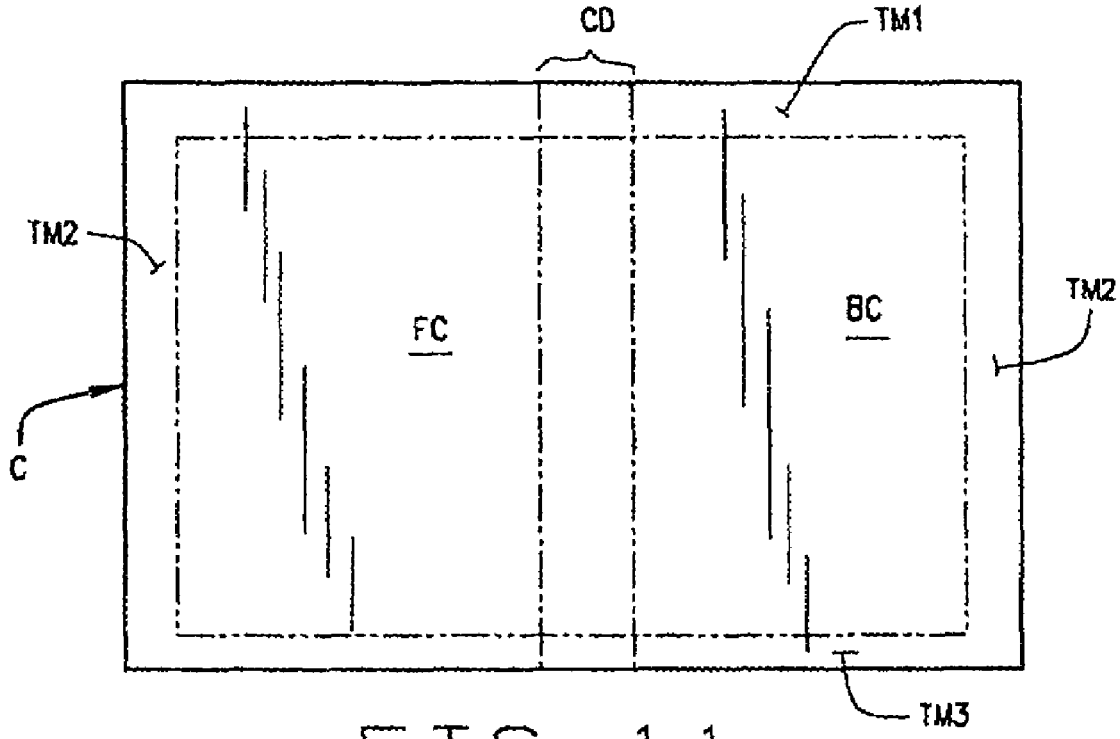
FIG. 11 is a plan view of a cover blank illustrating the front, back, and center portions of the cover and further illustrating the edges or margins of the cover to be trimmed to a predetermined size after the book has been bound.

As shown in FIG. 11, each book block BB is adapted to be bound in a suitable book cover C by a binding technique or method referred to as perfect binding. Typically, books bound by the perfect binding method are soft cover books. The book cover C is typically formed of a suitable stock of heavier weight than the pages of the book block BB and may be coated so as to have a superior finish and may be color printed. The cover has a front face FC, a back face BC, and a center portion CP therebetween. The width of the center portion CP of the cover C generally corresponds to the thickness of the book block to which it is ultimately attached. Typically, the pages P of the book block and the cover C are somewhat oversize relative to the desired size of the finished, bound book such that the margins of the bound book can be trimmed to a predetermined size after the book block has been bound to the cover to result in a perfect bound book having the desired size with even edges along the sides or margins (preferably along three sides) of the book. As shown in FIGS. 10 and 11, the oversize margins of the book block BB and of the cover C are shown as trim margins, TM1-TM3. For example, a book having a format of any finished (trimmed) size ranging from between about 5×7 inches to just slightly less than 8½×11 inches may be printed on conventional 8½×11 inch sheet stock. The text page printers 110 and 200 will print the text on a selected area of each page such that the text is spaced a predetermined amount from one edge of the page (the spine) and centered along the spine. In this manner, after the book is bound, the trim margins TM1-TM3 will be known to the control system CONT 1 and thus the trim margins may be accurately trimmed from the bound book at the trimming station TS so as to produce a book having uniform edges and having a predetermined finished size.

As noted, the book block BB and cover C may be printed by any method. However, because the printing and binding apparatus 1 of the present invention is capable of instant setup for any size or format of book to be bound (i.e., the size of the pages and the thickness of the book) within a predetermined range of book sizes (e.g., from 5×7 inches to about 8½×11 inches, and any combination of rectangular sizes within such range, and in thickness ranging from about 25 pages to about 1000 pages or more), the printing and binding apparatus of the present invention is particularly well-suited to print, bind, and trim a single copy (or a small run quantity) of perfect bound book(s) printed on-demand as described in U.S. Pat. No. 5,465,213, the disclosure of said patent being herein incorporated by reference. In this manner, the on-demand printing apparatus of the present invention can automatically, from the data relating to the size and thickness of the book to be bound, determine (calculate) the width of the center portion CP of the cover C and the width of the trim margins TM1-TM3 so as to bind any size book within the range of book sizes that can be accommodated by the printing and binding apparatus 1 of this invention. The second book may be of an entirely different size and thickness than the first book and the printing and binding apparatus 1 will automatically accommodate this second book so long as the second book is also within the range of book sizes that can be accommodated by the printing and binding apparatus. The binding process of the printing and binding apparatus has a sufficiently fast operational cycle such that it will finish binding and trimming one book while a second book is being on-demand printed.

As shown in FIGS. 13 and 14, the book cover printer 114 is positioned adjacent the binding station BS of the printing and binding apparatus 1. The book cover printer 114 is shown pulled slightly away from the apparatus in FIG. 13 to illustrate how it can be easily separated from the apparatus for servicing. The cover printer 114 is shown in its operative position relative to the apparatus in FIG. 14. The cover printer 114 has a slot 166 on the top of the printer where color printed book covers are ejected from the printer. Mounted on the top of the cover printer is the cover printer transfer mechanism 116 that projects outwardly from the printer to a position adjacent the binding station BS of the printing and binding apparatus 1.

The cover transfer mechanism 116 is comprised of a pair of C-shaped channels 168, 170 having openings that mutually oppose each other and extend along the length of the apparatus from positions over the printer 114 to positions adjacent the binding station BS of the apparatus. A plurality of cross bars 172 extend between the two channels 168, 170 forming the frame of the cover transfer mechanism 116. An additional plurality of bars 174 extend between pairs of the cross bars 172 rigidifying the frame and providing a sliding surface for the cover to be printed by the cover printer 114. A pivot rod 176 extends across an intermediate portion of the frame and has a plurality of pawls 178 secured to the rod. The pivot rod 176 is connected to a switch 180 that controls the operation of the cover transfer mechanism 116 as will be explained.

Figure 19:
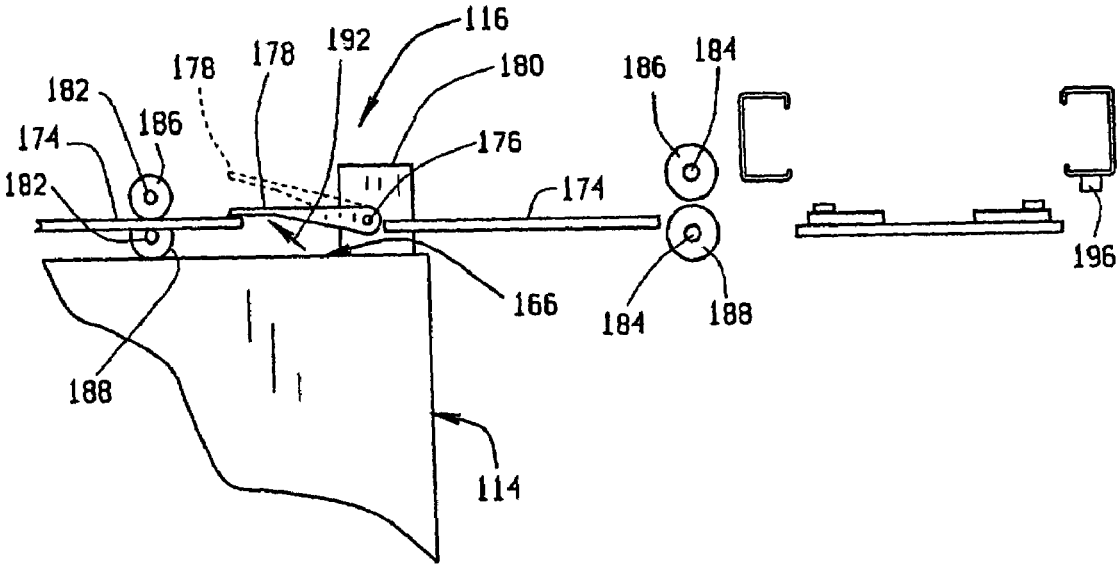
FIG. 19 is a schematic representation of the transfer mechanism of the cover printer relative to the printing and binding apparatus.
Figure 20:
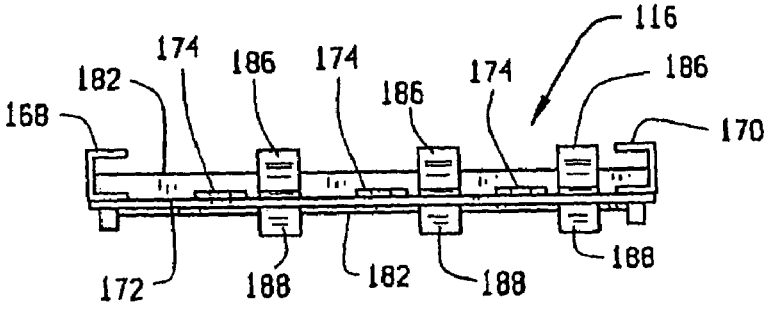
FIG. 20 is an end view of the transfer mechanism of the cover printer.
Figure 21:
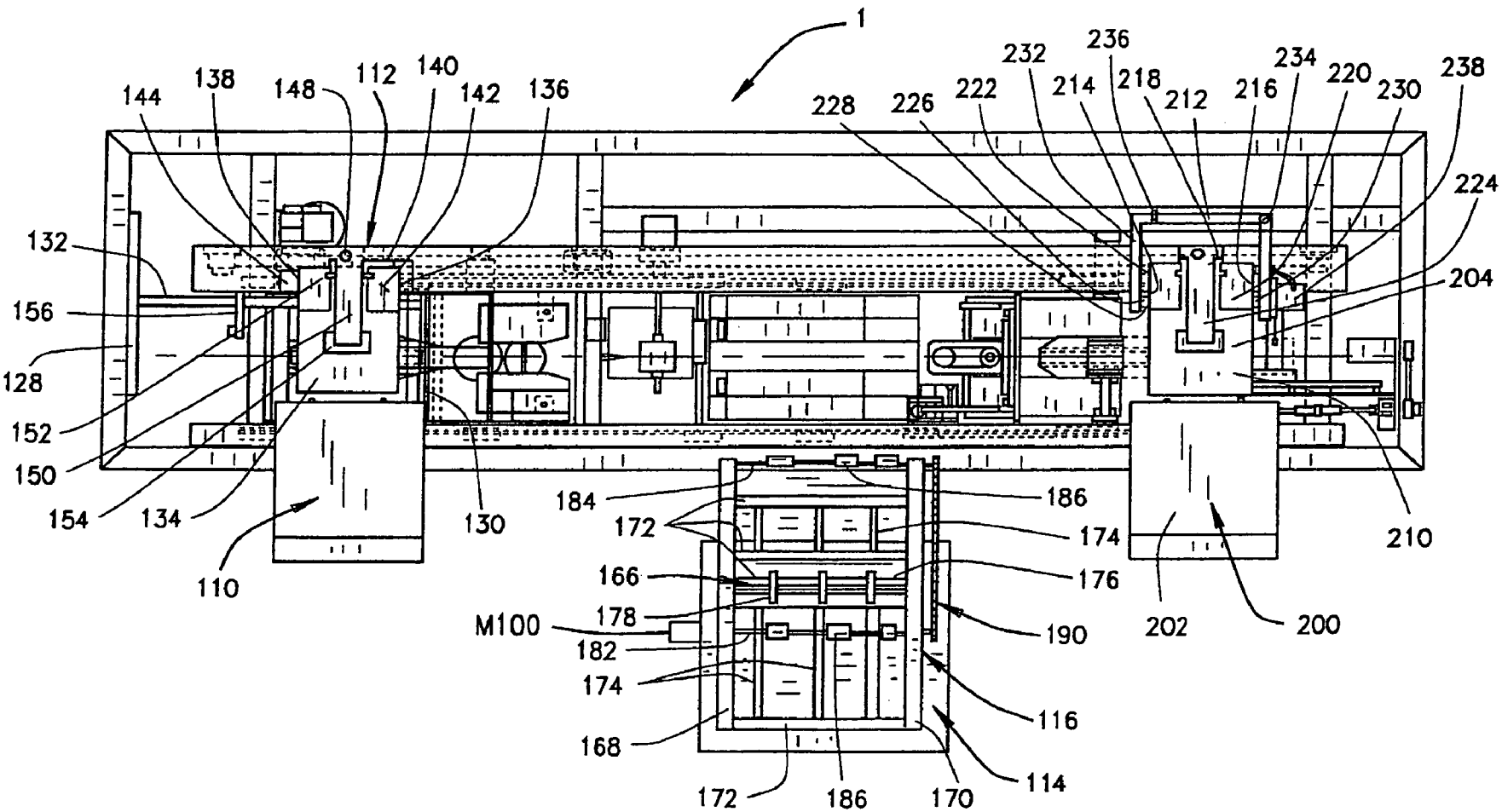
FIG. 21 is a top plan view of an alternative embodiment of the printing and binding apparatus of the present invention with a second book page printer and its transfer mechanism shown in their relative positions.

As shown in FIGS. 14, 19, and 20, two pairs of roller shafts 182, 184 are mounted for rotation to the channels 168, 170 of the frame on opposite sides of the pivot rod 176. Each of the shafts of the pairs are positioned above and below each other. Each of the pairs of shafts 182, 184 has three pairs of mutually contacting rollers 186, 188 mounted to the shafts for rotation with the shafts. The upper shafts of each pair are operatively connected together by a chain and sprocket connection 190 shown in FIG. 14. The chain and sprocket connection 190 and the mutual engagement between the roller pairs 186, 188 provide a driving arrangement between the rollers where, when the rollers on the upper shafts rotate in a clockwise direction, the rollers on the lower shafts rotate in a counter clockwise direction and vice versa. A reversible stepper motor M100, as shown in FIG. 21, is controlled by the control system CONT 1 and is operatively connected to the chain and sprocket connection 190 to drive the rotation of the upper and lower rollers in opposite directions of rotation. Motor M100 is also operatively connected with the pivot rod switch 180 to control the motor's direction of rotation, and thus the direction of rotation of the rollers 186, 188.

When the book cover printer 114 and its transfer mechanism 116 are operated, as each book cover is printed by the printer, the book cover is ejected from the top of the printer in the direction indicated by the arrow 192 shown in FIG. 19. The cover C being ejected from the printer contacts the plurality of pawls 178 and causes the pawls to move from their first position shown in solid lines in FIG. 19 to their second position shown in dashed lines in FIG. 19. The movement of the pawls to their second position activates the pivot rod switch 180, which in turn, controls the motor of the cover transfer mechanism 116 to rotate the upper rollers 186 of each pair of rollers to rotate in the clockwise direction and the lower rollers 188 of each pair of rollers to rotate in the counter clockwise direction as viewed in FIG. 19. The cover being ejected from the cover printer 114 is received between the pairs of rollers shown to the left in FIG. 19 and the rotation of the rollers transports the cover to the left as viewed in FIG. 19 between the opposed pair of channels 168, 170 and over the sliding bars 174 of the transfer mechanism frame. This movement of the cover continues until it is completely ejected from the cover printer 114 and moves past the plurality of pawls 178, causing the pawls 178 to move from their second position back to their first position shown in solid lines in FIG. 19. This movement of the pawls causes the pivot rod switch 180 to control the transfer mechanism motor (not shown) to reverse its rotation. The reverse rotation of the motor causes the upper rollers 186 of the pairs of rollers to now rotate in the counter clockwise direction and their mating lower rollers 188 to rotate in the clockwise direction. This, in turn, causes the pairs of rollers 186, 188 to transfer the cover to the right as viewed in FIG. 19 between the pairs of rollers and over the pawls 178 to the binding station BS of the apparatus. The rollers 186, 188 of the transfer mechanism 116 transfer the cover over the clamp members 35*a*, 35*b* with an edge of the cover sliding along the positioning pins 36 until the leading edge of the cover comes in contact with the stop switch 196 indicating the proper position of the cover over the center of the binding clamp 38. Alternatively, when only one size of cover stock is used to print the covers of all sizes of books, the positioning pins and the stop switch can be eliminated and replaced by a simple bin that is centrally positioned with respect to the binding clamps. In either manner, the cover printer 114 and its associated transfer mechanism 116 automatically operate to provide a color printed cover to the printing and binding apparatus 1 where it is ready to be secured to the book block by the apparatus.

Regardless of how the book block BB and cover C are printed, the book block BB is loaded in the carriage 7 which is movable along the conveyor 5 in a horizontal direction along the workpath WP. As will be described in detail hereinafter, the carriage 7 is substantially centered on the workpath WP and has a carriage clamping mechanism 9, which is selectively actuated to firmly hold the pages P of the book block relative to one another. This clamping mechanism 9 comprises vertical clamping members 11*a*, 11*b* which, upon actuation of the clamping mechanism, are preferably self-centering such that the book block BB, regardless of its thickness, is centered with respect to the workpath WP as it is held within the carriage 7. The self-centering drive of the clamping members 11*a*, 11*b* is driven by an electric motor M2. The motor M2 drives the clamping members toward each other via a suitable self-centering gear drive (not shown) such that they firmly grip the book block BB and such that when the motor M2 stalls or stops, the clamping members exert a sufficient gripping force on the book block so as to firmly hold the pages relative to one another as the book block is transported to the various stations along the workpath WP during the various operations that are preformed on the book block, as will be hereinafter described. When the book block is clamped, the clamping members 11*a*, 11*b* grip the front and back faces of the book block BB in a manner such that the lower margin adjacent the spine of the book block extends below the clamping members. The spine S of the book block preferably extends approximately 2.0 cm. below the clamping members when clamped.

As shown in FIGS. 1, 2, and 4, the carriage 7 and the book block BB carried thereby are shown in a first station, referred to as a jogging station JS, at which location the book block is deposited in the carriage 7, but is not clamped. In the jogging station JS, the pages of the book block are mechanically vibrated or jogged so as to allow the pages to move relative to one another such that the bottom most edges of all of the pages of the book block bear on a horizontal surface 13 and the leading, trailing, and upper edges of the pages are substantially aligned with one another. As previously stated, the lower lengthwise dimension of the book block, referred to as the spine S of the book block, rests on the surface 13 of the jogging station JS. The jogging operation is carried out by vibrating the book block in the carriage by an electromechanical vibrating mechanism 15 (as shown in FIG. 2), which has a vibrating magnetic coil (solenoid) 17 connected to the surface 13 by resilient arms 19. The magnetic vibrating coil is energized by a suitable power supply (not shown) under the control of the control system CONT 1. Preferably, during the jogging operation, the carriage clamp 9 is positioned in such manner as to loosely hold the pages P of the book block in vertical positions relative to one another such that they may move relative to one another during the jogging operation to permit the pages to align with one another. During the jogging operation, the pages of the book block are preferably vibrated in such manner that the pages move rearwardly relative to the carriage 7 such that the trailing edges of the pages of the book block contact a vertical surface 21 of the carriage. The vertical surface 21 of the carriage 7 thus provides an accurate reference position for the trailing edge of the book block that is later used to positively position the book block relative to the components of the apparatus as the book block is bound and trimmed.

Figure 18:
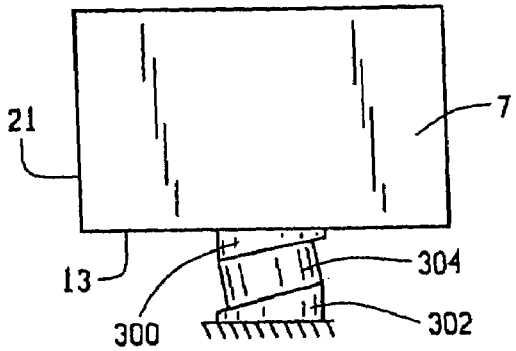
FIG. 18 is a schematic representation of an improvement to the secondary jogging apparatus.

One arrangement for accomplishing this jogging of the book block is shown schematically in FIG. 18. FIG. 18 shows the carriage 7 mounted on a vibrating device comprised of an upper angled block 300 and a lower angled block 302 with the vibrating mechanism 304 mounted between the two blocks. With the angled blocks 300, 302 above and below the vibrating mechanism 304, operation of the mechanism is split into two, perpendicular force components with one component directed upwardly and the other directed horizontally to the left as shown in FIG. 18. Thus, operation of the vibrating mechanism 304 will jog and collate the pages of the book block on the bottom surface 13 of the jogging station JS and against the left vertical surface 21 of the station.

Upon completion of the jogging operation (which may only take a second or so), the carriage clamp motor M2 is energized so at to actuate the clamp 9 to firmly clamp the pages of the book block together and to firmly hold the book block BB in a fixed position relative to the carriage 7 as the carriage is moved along the workpath WP. The thickness of the book block BB being bound and the clamping pressure exerted by the clamp members 11*a*, 11*b* is accommodated by energizing motor M2 to close the clamp and to allow the motor M2 to stall upon the clamp member firmly engaging the book block and exerting a clamping force thereagainst.

The control system CONT 1, upon being supplied with the size of the book block and cover of the book being bound, can then calculate the position of the leading edge of the book block relative to the carriage by reference to the vertical carriage surface 21. Thus, both the trailing and leading edges of the book block can be accurately located relative to each station of the printing and binding apparatus as well as the trimmer as the carriage is moved along the workpath from one station to the next.

Additionally, the horizontal plate 13 of the jogging station serves as a reference surface for establishing the elevation of the spine S of the book block as the latter is transported along the workpath WP. As noted above, the carriage 7 is moved along the workpath WP by the stepping motor M1 via the timing belt and pulley arrangement CB such that the position of the carriage (and hence the position of the book block carried thereby) may be accurately controlled at any point along the workpath to an accuracy of within about 0.005 inches or about 0.127 mm.

The carriage 7 and the book block BB carried thereby are moved by the conveyor 5 from the jogging station JS to a second station along the workpath WP. This second station is a milling station MS at which a rotary milling or spine grooving head 23 mills or otherwise removes material from the lowermost edge of each of the pages (i.e., the spine S) of the book block to thereby roughen the surface of the spine to better bond the adhesive to the spine and to insure that the spine is coplanar. The milling station MS is provided with a vacuum dust or debris collector 27, driven by a motor M3. The inlet opening for the dust collector is shown at 29 in FIG. 1. The milling head 23 is rotary driven by a motor M4 at high speed and has a milling blade 31 (as shown best in FIG. 2) which engages the spine of the book block as the latter is conveyed over the milling head by the carriage 7. It should be understood that the milling operation is only intended to remove only a minimal amount of material from the spine S of the book block, to roughen the surface of the spine and create a good adhesive gripping surface on the spine. The milling blade 31 is a single blade carried on the rapidly rotating milling head, configured to roughen and cut shallow grooves in the spine as the carriage moves the book block thereover. These grooves hold a supply of adhesive and facilitate the spine of the book block being firmly adhered to the center portion CP of the cover. The milling station utilized in the preferred embodiment of the printing and binding apparatus can be commercially acquired from Martin Yale Industries, Inc. of Wabash, Ind.

Downstream of the milling station MS along the workpath WP is next located an adhesive application station AS. As shown, this adhesive application station includes a hot melt adhesive bath 31 (as shown in FIG. 1) in which a quantity of a suitable hot melt adhesive, of the type which is well known in the book binding art, is heated to a liquid state. One such adhesive that has worked well in conjunction with the system and method of this invention is a hot melt adhesive commercially available from Capital Adhesives of Mooresville, Ind., recommended by the manufacturer for binding books. However, any suitable hot melt or cold melt adhesive may be used in accordance with this invention.

The adhesive application station AS further has an adhesive applicator roller 33 which is partially immersed in the liquid hot melt adhesive and which is rotary driven by a motor M5 such that the roller picks up a coating of the liquid hot melt adhesive on its cylindrical face. The upper portion of roller 33 is positioned to be generally tangent to the spine of the book block BB as the book block is conveyed by the carriage 7 along the workpath WP over the roller 33. Thus, as the spine of the book block is conveyed over the roller 33, a quantity of hot melt adhesive is applied to the spine of the book block. The roller 33 is rotary driven by the motor M5 at approximately the same speed as that of the carriage 7 moving along the workpath WP so as to pick up molten adhesive from the bath 34 and lay down a substantially continuous coating of the liquid hot melt adhesive on the spine S of the book block as the latter is conveyed over the roller. The roller motor M5 is energized and de-energized by a micro-switch (not shown) tripped by movement of the carriage 7 as it approaches and leaves the adhesive station. The hot melt bath and roller are commercially available. It should be understood that the bath 31 is provided with suitable heaters so as to heat the adhesive to a desired temperature and is further provided with a thermostat control system to maintain the adhesive in the bath at a desired temperature.

While the apparatus described herein is shown to utilize a hot melt adhesive, those skilled in the art will recognize that a cold (room temperature) adhesive could be used as well.

The book block BB is conveyed by the carriage 7 from the adhesive application station AS to the next work station, which is the binding station BS. At the binding station the binding clamp 35 is provided. The binding clamp is preferably of the type that is commercially available. The binding clamp includes a pair of self-centering, power operated clamp members 35*a*, 35*b*, driven by a motor M6, that are disposed on opposite sides of the book block. The clamp members 35*a*, 35*b* are driven between their open and closed positions by the motor M6 by means of a suitable gear train (not shown). As shown in FIG. 1, the clamp members 35*a*, 35*b* are in their open position with their inner edges spaced apart a distance sufficient to accommodate the thickness of the book block BB to be bound to a cover C.

Referring to FIG. 2, it can be seen that the clamp members 35*a*, 35*b* are positioned slightly above the bottom surface of the jogging station JS but below the carriage 7 such that the clamp members are disposed to engage the side faces of the book block below the level of the carriage clamp members 11*a*, 11*b*, and just above the level of spine S of the book block. As provided, one lateral side of the binding clamp is mounted by a hinge to the rail 3*a* and is selectively movable between a lowered position in which the clamp members 35*a*, 35*b* are positioned below the level of the spine S of the book block as the carriage 7 moves the book block (with the adhesive applied to the spine) into position over the binding clamp 35 assembly, and a raised position where the book block spine 5 engages against the binding clamp 38 and is positioned between the clamp members 35*a*, 35*b*. The clamp members 35*a*, 35*b* are provided with cover positioning pins 36 which accurately locate a cover C relative to the book block BB to be bound therein. In this manner, with the cover installed on the clamping members 35*a*, 35*b*, the center portion CP of the cover may be disposed over the opening between the clamping members 35*a*, 35*b* and positioned substantially centered with respect to the spine of the book block.

When the carriage 7 with the book block therein is stopped at the binding station BS, the book block is positioned above the cover C with the spine S of the book block over the center portion CP of the cover. With the book block BB in such position, it will be understood that the book block is substantially in register with the center portion of cover C and that the book block is substantially centered in heightwise relation with the cover. The book block is transported from the adhesive application station to the binding station in such a short time that the adhesive substantially does not appreciably cool or otherwise begin to set up before the binding operation begins. With the book block substantially correctly positioned with respect to the cover (i.e., the center of the spine S of the book block is centered with respect to the cover both laterally and longitudinally), a combination hydraulic pump/electric motor PM4 is energized so as to pressurize a fluid cylinder 37 to effect the raising of the clamp assembly 35 from its lowered position to a raised binding position in which the clamp assembly 35 is substantially horizontal. As the clamp is raised, a surface 38 of the clamp between the clamp members 35*a*, 35*b* is moved into engagement with the center portion CP of the cover from below the outer face of the center portion of the cover C so as to raise the cover and to force it into adhesive engagement with the adhesive applied to the spine S of the book block. The clamp members 35*a*, 35*b* are then power driven toward each other by means of a motor M6 which acts through a self-centering mechanism so as to insure that the clamp members 35*a*, 35*b* substantially simultaneously engage the outer surface of the cover of the book immediately above the level of spine S. As the clamp members 35*a*, 35*b* close on the cover C and the book block BB, the motor M6 stalls, thus insuring that sufficient clamping force has been applied to properly bind the book.

As the clamp members 35*a*, 35*b* clamp on the cover of the book block, the cover stretches around the spine and the lower margins of the book block BB proximate the spine S to insure that the cover tightly conforms to the spine of the book block, preferably without the formation of wrinkles in the center portion CP of the cover C. While it has not been found necessary to do so in all cases, for some cover stock materials which are thicker than conventional cover stock material, the cover C may be scored along either side of the center portion CP of the cover in the manner described in U.S. Patent No. 6,142,721 which is herein incorporated by reference. The clamp members 35*a*, 35*b* hold a clamping force on the front and back face of the cover of the book being bound just above the level of the spine S for only a few seconds to allow the adhesive to properly set (i.e., cool), thereby binding the book block to the inner face of the center portion of the cover. The outer surfaces of the clamp members 35*a*, 35*b* may be coated with a suitable low friction/non-stick material such as a Teflon tape to insure that cover C does not adhere to the clamp members and to insure that any excess hot melt adhesive may be readily cleaned from the clamp members. It should be understood that the spine S of the book block is not necessarily in a tight compressive relation with the cover, after the binding clamp 35 has been moved fully to its raised position, but that there may be a desired gap (e.g., a few mm) between the bottom face of spine S and the inner face of the center portion CP of the cover so as to insure that a layer of adhesive remains between the spine and the cover so as to result in the satisfactory binding of the book block to the cover. It should also be understood that if the spine were tightly forced onto the inner face of the cover, excessive amounts of the still liquid (or otherwise flowable) adhesive may be forced from between the spine and the cover so as to result in a weakened binding of the book. Furthermore, it should be understood that the transverse grooves (not shown, but which may, for example, be about ⅛ inch wide, 0.020 inches deep, and on about ⅜ inch centers) which are optionally formed in the spine S of the book block by the milling knife 31 act as a reservoir for holding an extra amount of the adhesive and to present additional surface area for the adhesive bonding of the pages to the cover and to one another. Yet further, it should be understood that, with the pages of the book block BB held tightly by the carriage clamp members 11*a*, 11*b* at the binding station and with the cover C disposed on the upper face of the binding clamp assembly 35 (as positioned by locating pins 36), the upward movement of the binding clamp assembly 35 causes the cover to splay outwardly relative to the book block with the front and back cover FC and BC, respectively, being in nearly horizontal position beneath the carriage 7.

Yet further, it should be understood that the hot melt adhesive, as above described, may be omitted and replaced with a room temperature adhesive, such as that described in U.S. Pat. No. 6,142,721, which is herein incorporated by reference. In such instance, rather than applying a coating of a hot melt adhesive to the spine S of the book block BB (as above described), a suitable quantity of the room temperature, solid adhesive may be adhered to the inner face of the center portion of the cover C or to the spine S of the book block as the book block is conveyed along the workpath WP. In the event that such room temperature adhesive is used, the adhesive station AS, heretofore described, is replaced with the adhesive application station, as described in the above noted U.S. Pat. No. 6,142,721. Furthermore, the binding station BS, as described above, is replaced with the ultrasonic adhesive activation system described in the above-noted patent. In such ultrasonic adhesive activation systems, an ultrasonic horn (tool), as described in the above-noted patent, is brought into working engagement with the lower surface of the center portion CP of the cover C and the tool is caused to resonant to thereby transmit ultrasonic energy from the tool through the thickness of the cover so as to activate or melt the adhesive. The ultrasonic energy aids in forcefully driving the now activated or liquefied adhesive into adhesive engagement with pages comprising the book block BB. In this manner, the ultrasonic energy forces the adhesive vertically a short distance (e.g., a few hundredths of an inch) between the lowermost edges of the pages of the book block adjacent the spine S to imbed the edges of the pages of the book block into the adhesive and to insure that the inner face of the center portion of the cover is adhered to the spine of the book block. It should be noted that the time required for such ultrasonic energy to activate the adhesive may be very short (a fraction of a second), depending on the thickness and height of the book being bound. Upon removal of the ultrasonic energy, the adhesive will substantially instantaneously cool, thus allowing the bound book to be quickly released from the clamping members 35*a*, 35*b*. In accordance with this invention, the printing and binding apparatus 1 may be readily converted between use of hot melt adhesives and room temperature adhesives which must be ultrasonically activated. In order to readily accomplish this changeover, the adhesive application station AS using hot melt adhesive (as herein described) may be removed from the frame 3 as a unit and replaced with the room temperature adhesive applicator and ultrasonic adhesive activation unit, as described in the above-noted patent.

Within the broader aspects of this invention, the adhesive application station may apply the adhesive directly to spine S of the book block BB. Alternatively, the adhesive may be applied first to a central or selected area of cover C. The term "application of adhesive so as to be disposed between the spine and the cover upon binding of the book", or similar words, is intended to mean either applying the adhesive directly to spine S or directly to a designated area of the cover C.

As noted above, the cover C and the pages P constituting the book block BB are oftentimes printed on oversize stock which needs to be trimmed along three (3) edges or trim margins TM1, TM2 and/or TM3 (i.e., along the top, outer, and bottom margins) of the bound book so as to produce a bound book of a precise, predetermined size with uniform top, bottom, and outer edges. The cover stock from which the cover C of the on-demand printed book is produced may be of a size such as to allow a wide range of book thicknesses to be printed using the same stock size for the cover. To facilitate the use of a common cover stock size, the width of the cover center portion CP is adjustable to accommodate books of a wide range of thicknesses and each graphic of each cover can be printed substantially centered with respect to the stock cover size, such that no mechanical adjustments are necessary to print books of varying thicknesses.

In accordance with one aspect of the printing and binding apparatus 1 of the present invention, the carriage 7 further transports the now bound book from the binding stations BS to another work station, referred to as the trim station TS, along the workpath WP. In the manner as will be described, one, two, or three edges of the bound book (i.e., the book block BB and the cover C) are trimmed (i.e., the above-described trim margins TM are removed) at the trimming station TS to provide the bound book with a precise, predetermined size having neat and uniform edges. Referring to FIG. 2, as the bound book is transported by the carriage 7 from the binding station BS to the trimming station TS, the cover is bonded to the spine of the book block, but the cover is splayed into a partially open position (i.e., the cover does not lie flat on the book block) and the carriage clamping members 11*a*, 11*b* are maintained in clamping engagement with the front and back faces of the book block. Further, the spine of the book is disposed at the lower horizontal edge of the book and the trailing edge of the book block remains in engagement with the vertical wall 21 of the carriage 7 thereby accurately maintaining the position of the book relative to the carriage. In this manner and since the control system CONT 1 "knows" the desired final (predetermined) size of the finished book, the size of the stock used for the pages P of the book block BB, and the size of the stock used to print the cover C, the control system has sufficient information to calculate the trim margins TM along the top, bottom, and outer edges of the book so as to result in a finished, trimmed book of a desired size.

As the carriage 7 moves along the workpath WP to the trimming station TS, the book clamp motor M2 is energized so as to open the carriage clamp members 11*a*, 11*b* and thereby release the bound book B, allowing the book to drop vertically downwardly into a trimming nest, as generally indicated at 41. After the book has been released and dropped into the nest 41, the carriage 7 is advanced along the workpath WP so that the vertical reference surface 21 of the carriage again engages the trailing edge of the book block and nudges the book in the nest 41 in a forward direction (i.e., toward the right-hand end of the apparatus 1, as shown in FIG. 1), thereby accurately positioning the book in the nest 41 relative to a trimming knife (as will be hereinafter described) so that the trim margins TM may be accurately trimmed from the book to give the book its predetermined dimensions. With the book properly positioned in the nest 41, the book is positioned with its spine constituting its lower edge, with its pages vertical, and with one edge to be trimmed disposed toward the trimmer. The front and back faces FC, BC of the cover C are disposed against the front and back pages of the book block such that the book is in its normally closed position.

The nest 41 of the trimming station TS is mounted on a vertically movable nest elevator 43 that may be selectively moved in the vertical direction. The elevator is moved along a vertical track 45 on track rollers 47 by a power screw drive 49 which includes a vertical drive screw 51 journalled in bearings 53 mounted to the frame 3 of the printing and binding apparatus. The drive screw is rotary driven by an electric stepper motor M7 through a timing belt and pulley drive, as indicated at 55. In this manner, the nest 41 is moved to its raised position (not shown) at which location it receives the bound (but not yet trimmed) book B from the carriage 7. With the book B received in and properly positioned relative to the nest 41, the stepper motor M7 is energized so as to rotate the drive screw 51 which lowers the nest 41 from its raised to its lowered trimming positions (as shown in FIG. 2).

Figure 5:
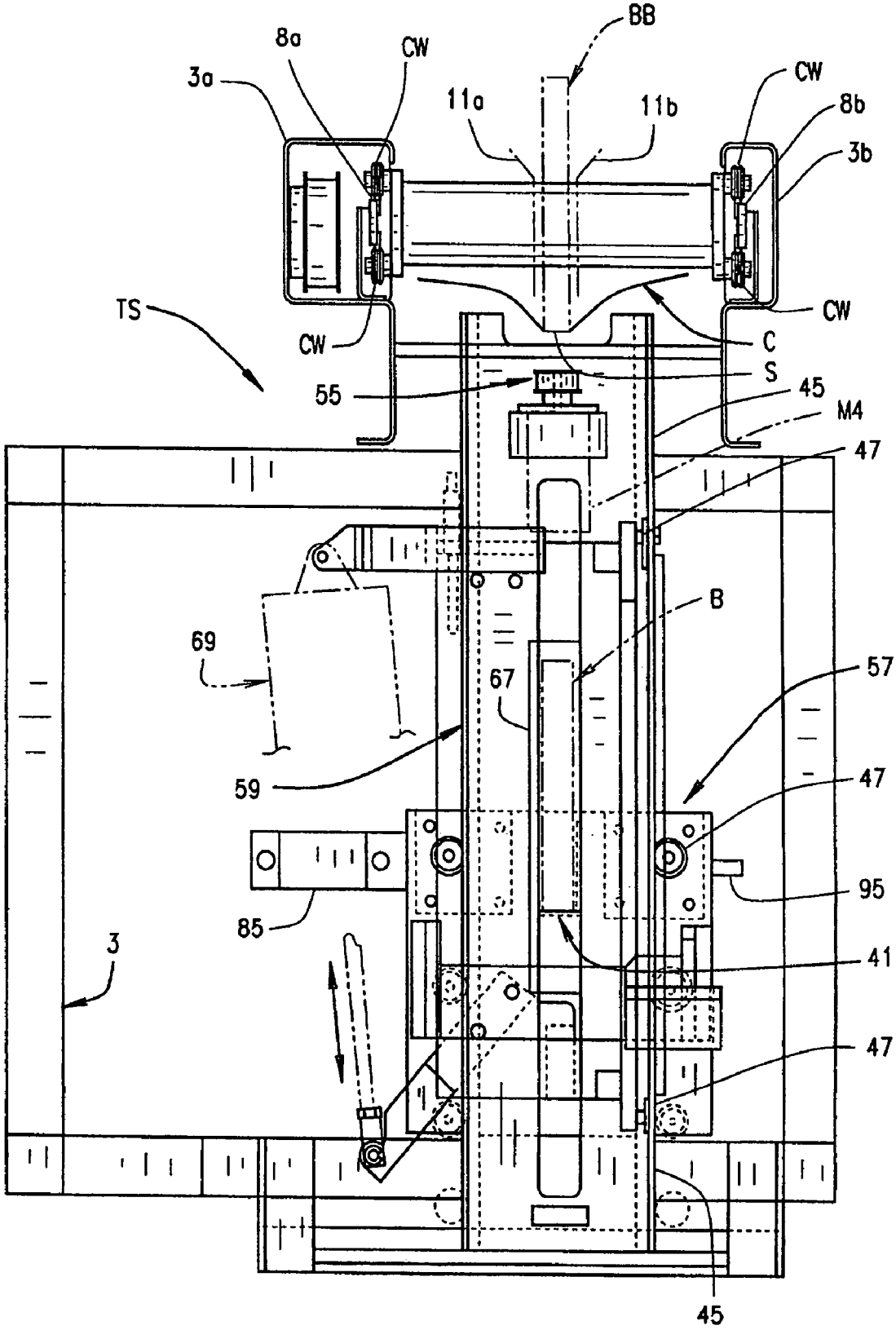
FIG. 5 is a partial end view, having a slightly larger scale than FIGS. 1-4, of the binding and trimming apparatus of FIG. 2, taken along the line 5-5 of FIG. 2, illustrating the shear trimmer partially broken away so as to show the nest that receives a bound book and holds the book while the book is being trimmed along predetermined edges or margins thereof.
Figure 7:
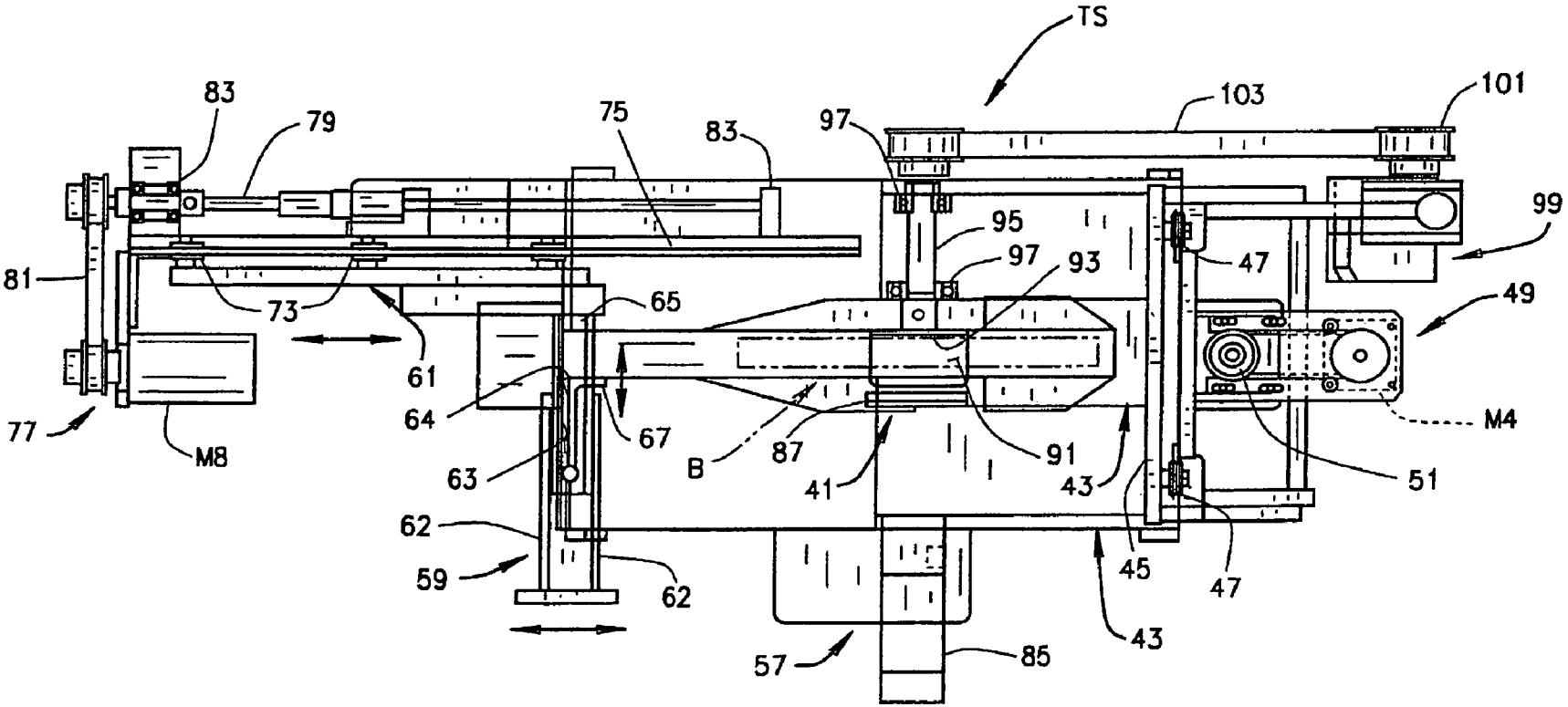
FIG. 7 is a top plan view of FIG. 6 illustrating the trimming station.
Figure 8:
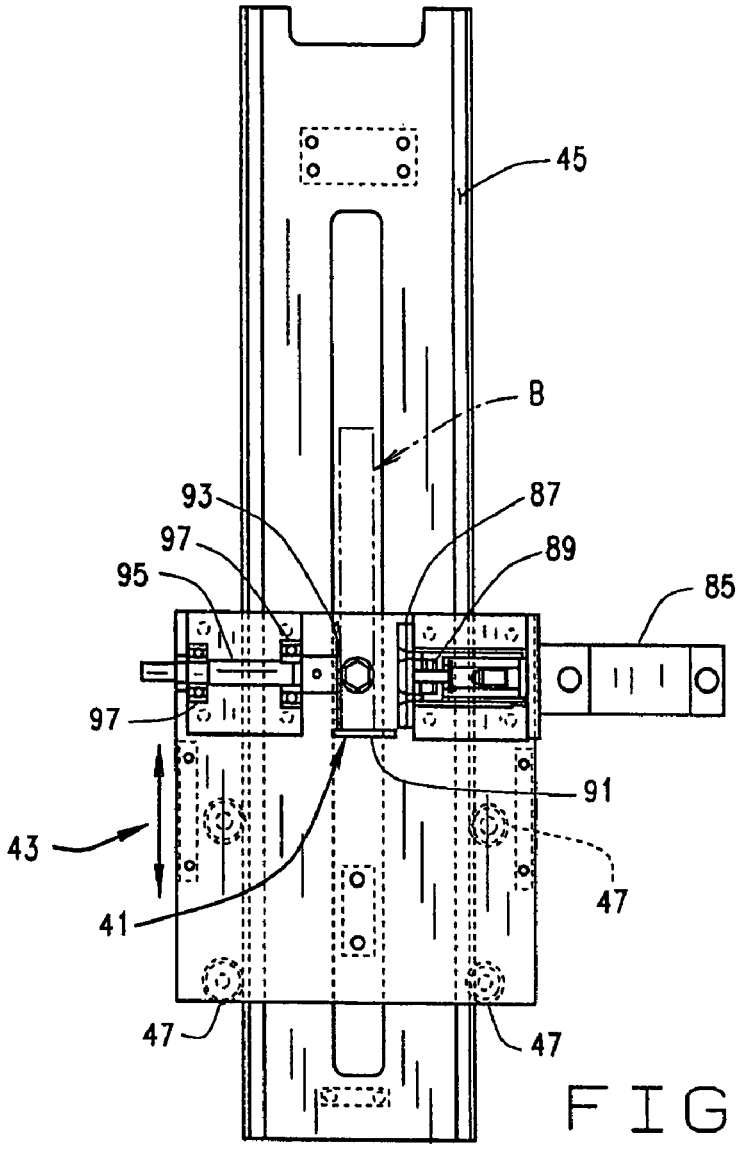
FIG. 8 is partial end view taken along line 8-8 of FIG. 6 illustrating the book receiving nest that is movable in a vertical direction between a raised position in which the nest receives a bound book to be trimmed and a lowered position (as shown in FIG. 6) in which the book held in the nest is in position to be trimmed by the shear-type trimmer.
Figure 9:
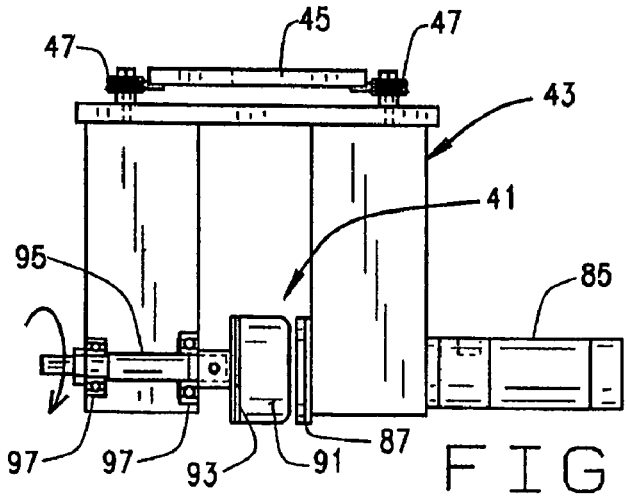
FIG. 9 is a top plan view of FIG. 8.

The nest 41 includes a book clamp 57, as best shown in FIGS. 5, 7, and 8, for holding the bound book B while one or more edges thereof are trimmed. The details of the book clamp 57 and the nest 41 will be more fully described hereinafter. However, the book clamp 57 includes an indexing mechanism, as generally indicated at 99 (which is also described hereinafter), that operates to rotate the book B held in the nest 41 through various angles (or through any desired angle) from a first position in which a first edge or trim margin TM1 of the book B is trimmed, to a second in which the book is rotated to a set position, for example rotated 90° such that a second edge or trim margin TM2 of the book is in position such that it may be trimmed, and then to a third position in which the book is rotated to another set position, for example rotated an additional 90° such that a third edge or trim margin TM3 of the book may be trimmed. Finally, book clamp 57 may be retracted or opened to release the trimmed book B.

As generally indicated at 59, a book shear or trimmer is provided which may be adjustably moved into operating relation with a book held in the nest 41 for trimming one, two, or three sides or edges of the book. Preferably, the trimmer 59 is a knife shear of sufficient length to trim the lengthwise dimension of the largest book B to be bound and trimmed by the apparatus 1 of the present invention. The trimmer 59 is vertically mounted on a trim carriage 61 which is mounted for horizontal movement toward and away from an edge of the book B held in the nest 41 such that the horizontal position of the trimmer (and more particularly the vertical plane of the blade of the trimmer) relative to the edge of the book being trimmed determines the amount of the margin of the book B to be trimmed. Of course, the horizontal position of the trim carriage 61 (and hence the position of the trimmer 59) is under the control of the control system CONT 1, as will be explained.

Figure 6:
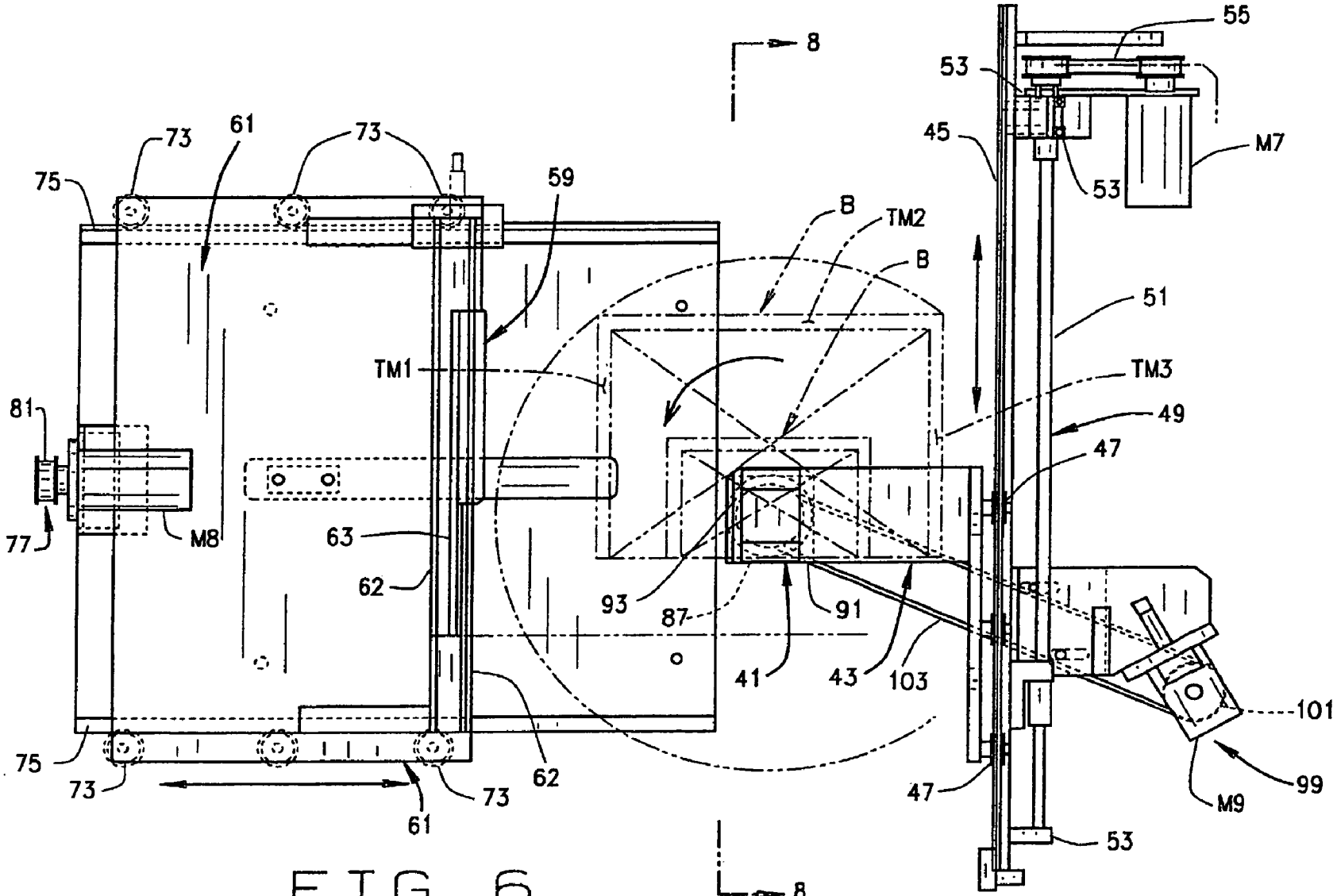
FIG. 6 is a partial side elevation view of the left-hand portion of FIG. 4 illustrating the trimming station on a slightly larger scale.

As best shown in FIGS. 6 and 7, the trimmer 59 comprises a trimmer frame 62 in which a guillotine-type shear blade 63 having a shear edge 64 (as shown in FIG. 7) is mounted to move between a fully open position and a closed trimming position. The trimmer further comprises an anvil 65 against which the book B in the area to be trimmed rests and against which the blade edge 64 cuts through the upper face of the cover C, the pages P of the book block BB, and through the other face of the cover to trim an edge or margin of the bound book B. The trimmer further has a book clamp 67 which is operable independently of the trimming blade 63 for firmly holding the book relative to the trimming blade adjacent the trim line (i.e., the line along which the blade 63 will trim the edge of the book upon closing of the trim blade 63) to insure that the trim blade uniformly trims the edge of the book being trimmed. The trimmer described herein is shown to have only a single shear blade 63. However, those skilled in the art will recognize that other trimmers may be used with the apparatus of this invention having three shear blades, one for each edge of the book to be printed.

Movement of the trim blade 63 between its open and closed positions is power operated by means of a fluid cylinder, as indicated at 69 (see FIG. 5). Further, the clamp 67 is power driven by another fluid cylinder 71. Each of these fluid cylinders is preferably hydraulic, but those skilled in the art will recognize that pneumatic cylinders or other devices may be used. Each of the fluid cylinders 69, 71 is supplied hydraulic fluid under pressure from a dedicated unitary hydraulic pump/electric motor (not shown). Such pumps may be driven in forward or reverse directions to reverse the pressure supplied to the cylinders 69, 71 so as to reverse their direction of movement. Thus, opening and closing of the shear blade and the shear clamp may be controlled (initiated) merely by reversing the operation of the pumps without the need for any expensive hydraulic valves or the like. Of course, those skilled in the art will recognize that many other arrangements for supplying hydraulic fluid under pressure to the fluid cylinders 69 and 71 may be used and that pneumatic, electromechanical, and/or other means could be used in place of the fluid cylinders themselves.

As noted, the trimmer 59 is mounted on the trim carriage 61 for movement in the horizontal direction toward and away from an edge of the book B being trimmed as the book is held in the nest 41. More specifically, the trim carriage 61 is mounted on track rollers 73 which roll on a trim carriage track 75 that is rigidly mounted to the frame 3 for movement of the trimmer between a retracted position (as shown in FIG. 6) where the trimmer will be clear of the maximum size book that can be trimmed. In the retracted position, the book can be rotated in the apparatus into a trimming position as it is held in the nest 41 for presenting another edge or margin of the book to the trimmer for being trimmed. In the trimming position, the plane of the shear blade 63 is accurately positioned with respect to a margin of the book B to be trimmed. The trim carriage 61 is power driven by a power drive 77 for movement between its retracted and trimming positions. The power drive 77 is shown to comprise an electric stepper motor M8 which drives a drive screw 79 by means of a belt and pulley arrangement 81. The drive screw 79 is journalled with respect to the trim track 75 by means of bearings 83. Under the control of the control system CONT 1 of the present invention, the stepper motor M8 is controlled so as to accurately position (e.g., to within ±0.005 inches) the cutting plane of the shear knife 63 relative to the margin of the book B to be trimmed such that a predetermined trim margin TM is removed from the book B along the vertical edge of the book presented to the trim blade.

The trimmer 59 described above is the trimmer described in my U.S. Pat. No. 6,193,458, which is herein incorporated by reference. It will be understood, however, that while such a trimmer works well in this instance, a trimmer, as disclosed in my pending U.S. patent application Ser. No. 09/960,148, which is herein incorporated by reference, may be used as well. In particular, it will be understood the blade and actuation system of this last-mentioned U.S. Patent Application may be used in place of the blade 63 and blade actuation system, as above. As shown best in FIG. 7, the book clamp 57 carried by the nest 41 comprises a fluid piston/cylinder actuator 85 having a book pressing platen 87 on its inner end for pressing against one face of the book B deposited within the nest 41. The fluid cylinder 85 is powered by a unitary pump/electric motor (not shown) similar to the above described pump/electric motors used to supply fluid pressure to the cylinders 69, 71 described above. The pressing platen 87 is journalled on the rod of the cylinder 85 by means of a bearing 89 so as to readily permit rotation of the book B with respect to the cylinder as the book B is held in clamped relation with the platen 87 when the book is in the nest 41 so as to permit a second and then a third margin of the book to be rotated into position for being trimmed by the blade 63. The nest 41 includes a lower reference surface 91 for engagement with the spine S of the book B as the book is deposited within the nest. The nest further has a wall 93 extending upwardly from the surface 91 which bears against a vertical face of the bound book B. This wall 93 is mounted on a rotary shaft 95 that is mounted in bearings 97 carried by an elevator 43. As shown in FIG. 8, upon pressurization of the cylinder 85, platen 87 is forcefully moved inwardly toward the book B held in the nest 41 to thereby firmly grip the book between the platen 87 and the vertical wall 93 which in turn is rotatably mounted on the shaft 95 which is carried by the bearings 97. In this manner, the book B is firmly held in place within the nest 41, thereby enabling positioning of the blade 63 relative to the known position of the book in the book nest to enable a predetermined trim margin TM1-TM3 to be trimmed from each of three respective margins or sides of the book B.

Preferably, the book B is positioned in the nest 41 such that the geometric center of the finished book is coaxial with the centerline of the book clamp cylinder 85 and the shaft 95 such that, as the book is rotated, the book will rotate about the axis of the finished book (i.e., the center of the book as trimmed).

As shown best in FIGS. 6 and 7, the index drive 99 is mounted on the elevator 43 for indexing the shaft in increments of 90° so as to rotate the book B held within the nest 41 through a predetermined angle (e.g., 90°) about the horizontal axis of the shaft 95 to present a second and then a third edge of the book B for being trimmed by the blade 63. More specifically, the index drive is a stepper motor M9 connected to the shaft 95 by means of a belt 103 and pulley arrangement. Upon energization of the stepper motor M9 for a predetermined number of counts by the control system CONT 1, the shaft 95 (and hence the book B) rotates a 90° such that another edge or margin of the book B is rotated to assume a vertical position where a predetermined trim margin for that edge or side of the book B may be trimmed by the trimmer 61. It should be understood that other arrangements for indexing the book B may be used. For example, a hydraulically driven index mechanism may be used to rotate the book through angles of 90° or through other desired angles. For example, the book could be rotated through 180° between trimming of the top and bottom margins of the book without the trimming blade being horizontally repositioned. In addition, multiple trimming blades could be used to trim the book margins simultaneously.

Referring to FIG. 6, as shown within the phantom line circle, a range of sizes of books B held by the nest 41 is depicted that can be accommodated by the trimming station TS of the present invention. As shown, both the smallest and largest sizes of the books B accommodated by the apparatus of this invention is shown with the spine S of such books B bearing on the upper face of the nest surface 91, thereby properly positioning the book in heightwise orientation relative to the shear blade 63. The phantom line circle depicts the swing of the largest size book as the book is rotated from the first position to the second and then the third positions.

With the book positioned within nest 41 in the first position such that the book's leading vertical edge and its trim margin TM1 are disposed toward the shear 59, the control system CONT 1 operates to energize stepper motor M8 an amount so as to move shear trimmer 59 horizontally from its retracted position (as shown in FIG. 6) to a predetermined trimming position in which the vertical cutting plane of the trimmer is oriented such that the trimmer will shear the trim margin TM1 from the book. With the shear 59 in this first trimming position, the pump PM2 is energized so as to close the shear clamp 67 on the book to firmly hold the book while the trim margin TM1 is sheared from the book. Then, the shear pump PM1 is energized so as to actuate the cylinder 69 to forcefully move the blade 63 from its open position to its closed position so as to cut the desired trim margin TM1 from the book. After the shearing operation is complete, the pump motors PM1, PM 2 are energized in a reverse direction so as to open the clamp and move the shear blade to its open position.

After trimming of the first trim margin TM1, the stepper motor M8 is energized so as to horizontally move the trim carriage 61 back to its retracted position from its cutting position. After the shear 59 is clear of the book circle, the stepper motor M9 is energized so as to index the nest 41 (and hence the book held therein) 90° about the horizontal axis of the shaft 95 to dispose a second edge or trim margin TM2 of the book in a vertical position. The control system CONT 1 is provided with information so as to calculate the shear plane of the shear 59 in relation to the book, as discussed above, so that the second trim margin TM2 may be trimmed from the book. With the book rotated to this second position, the stepper motor M8 is energized to move the trim carriage 61 in the horizontal direction toward the book so that the shear plane of the blade 63 is positioned where the shear 59 can remove the second trim margin TM2 from the book. Again, pump PM2 is energized to actuate the shear clamp 67 and then the shear pump PM1 is energized so as to trim the second trim margin TM2 from the book. Once again, the pump motors PM1, PM 2 are energized so as to open the clamp and move the shear blade into its open position and the stepper motor M8 is energized so as to horizontally move the trim carriage 61 clear of the book. Finally, the book is indexed through another 90° angle so as to position a third edge or trim margin TM3 of the book in a vertical position disposed toward the trim blade 63. In the manner heretofore described, the shear carriage is moved inwardly toward the book and the vertical plane of the shear blade is positioned so as to trim the third trim margin TM3 from the book, thereby forming a book having three trimmed edges and an accurate, predetermined size. After the trimming is complete, the shear carriage is moved to its retracted position where it is clear of the book and the nest clamp cylinder is retracted to thereby release the book.

It should be noted that it may not always be required to return the trimmer 59 to its retracted position after trimming of each edge of the book and that the trim carriage may be maintained in substantially its trimming position, moving only a minimal distance while the book is rotated from one trimming position to another. By not having to retract and advance the trimmer fully between its trim and retracted positions when trimming each edge of the book, the time required for trimming the book may be reduced. Furthermore, by moving the trimmer only a minimal amount, as needed during the rotation of the book, the book can remain positioned between the shear clamp 67 of the trimming carriage 61, albeit without the shear clamp firmly grasping the book, as the book is rotated. This prevents the opposite faces of the book cover from naturally splaying apart and where they could possibly fail to reenter the shear clamp 67.

An alternative embodiment of the printing and binding apparatus of the invention is shown in FIGS. 21-24. The alternative embodiment of the printing and binding apparatus incorporates a second, book page printer assembly 200 attached to the printing and binding apparatus 1 at a location along workpath WP separate from the location of the first text page printer assembly 110. For example, the second text page printer assembly 200 may be located at the opposite end of the workpath WP from the first described book page printer assembly 110. In operation, the second, book page printer assembly 200 functions similar to the first book page printer assembly and is configured to print and initially collate the pages of a book block and to load them into the carriage 7 in substantially the same manner a the first book page printer assembly 110. Use of the second, book page printer assembly 200 increases the production rate of perfect bound books produced by the printing and binding apparatus 1 by effectively cutting in half the time required to print the pages of the book blocks.

The second, book printer assembly 200 comprises a printer 202 and a transfer mechanism 204. The printer 202 of the second, book printer assembly 200 is preferably a black and white printer that is identical to the printer 110 of the first, book page printer assembly described above. It should be understood, however, that the printer 202 of the second, book page printer assembly 200, could be any type of printer, including a color printer if so desired, and need not be identical to the printer 110 of the first, book page printer assembly. The second printer 202 is mounted to the frame 3 of the printing and binding apparatus 1 adjacent the trimming station TS at the opposite end of the workpath WP from the printer 110 of the first, book page printer assembly. Like the first, book page printer assembly, the printer 202 of the second, book page printer assembly 200 is preferably mounted to the printing and binding apparatus 1 by a support platform 206 that is attached to the frame 3 of the printing and binding apparatus by a vertically hinged support member 208. In general, the printer 202 of the second, book page printer assembly 200 functions identically to the printer of the first, book page printer assembly.

The transfer mechanism 204 of the second, book page printer assembly 200 comprises a rectangular tray 210 and a support bracket 212. The tray 210 is preferably a mirror image of the tray of the first, book page printer assembly and includes identical features such as a box shaped bin having first 214 and second 216 side walls, a rear wall 218, and a top wall 220, a vibrating mechanism 222 for initial jogging and collating of the printed pages of the book block, and a screw driven clamping arm 224. A shaft 226 is mounted to the support bracket 212 for rotation about the shaft's axis. The tray 210 is mounted on the shaft for rotation with the shaft. Like a mirror image of the shaft 132 of the first, book page printer assembly, the left most end 228 of the shaft 226 of the second, book page printer assembly is oriented slightly above the opposite right end 230 of the shaft such that the shaft and tray 210 are angled slightly from the horizontal.

Figure 22:
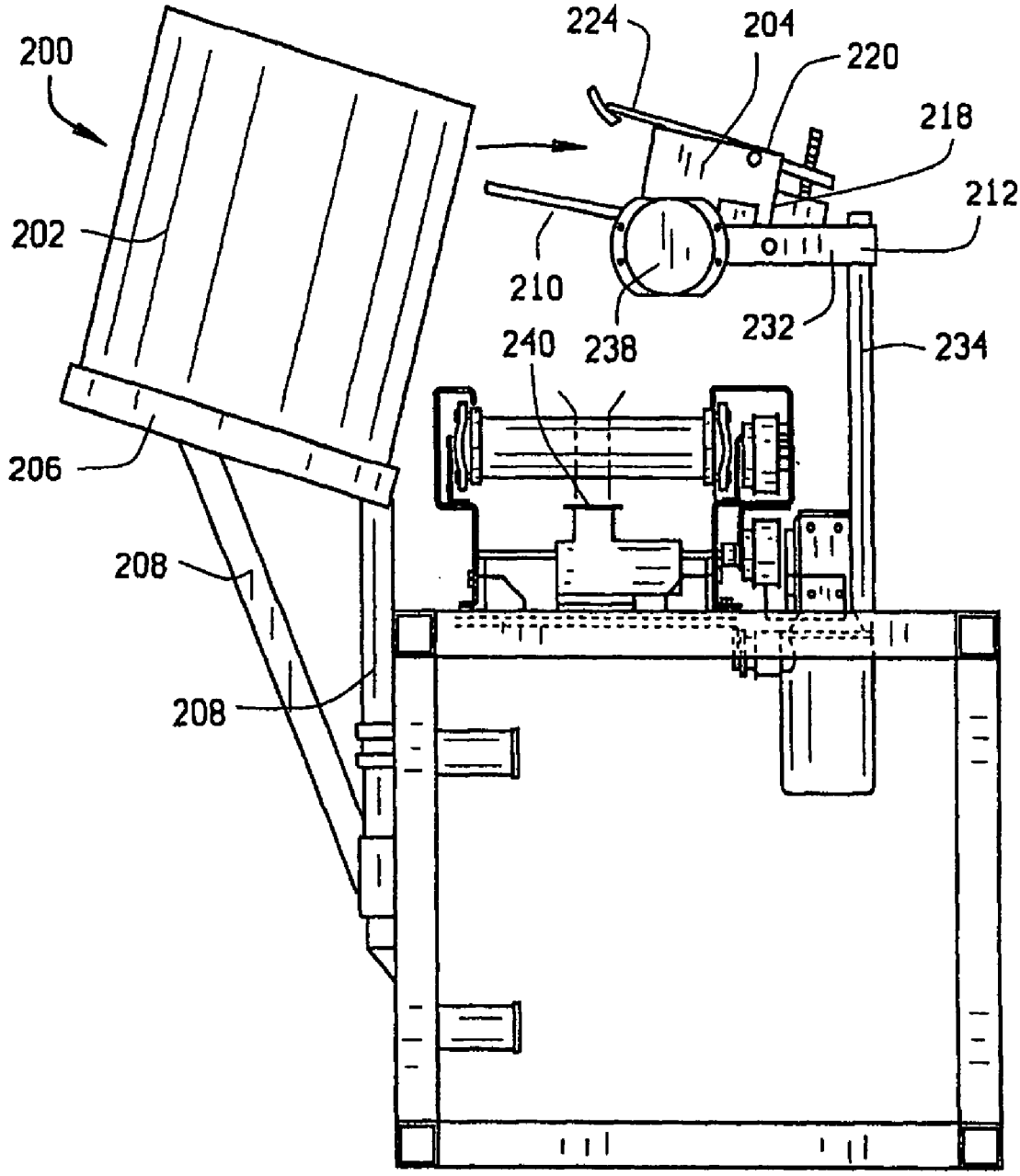
FIG. 22 is a right end elevation view of the alternative embodiment of the printing and binding apparatus showing the second, book page printer in a position for initially collating a book block printed via the second, book page printer.
Figure 23:
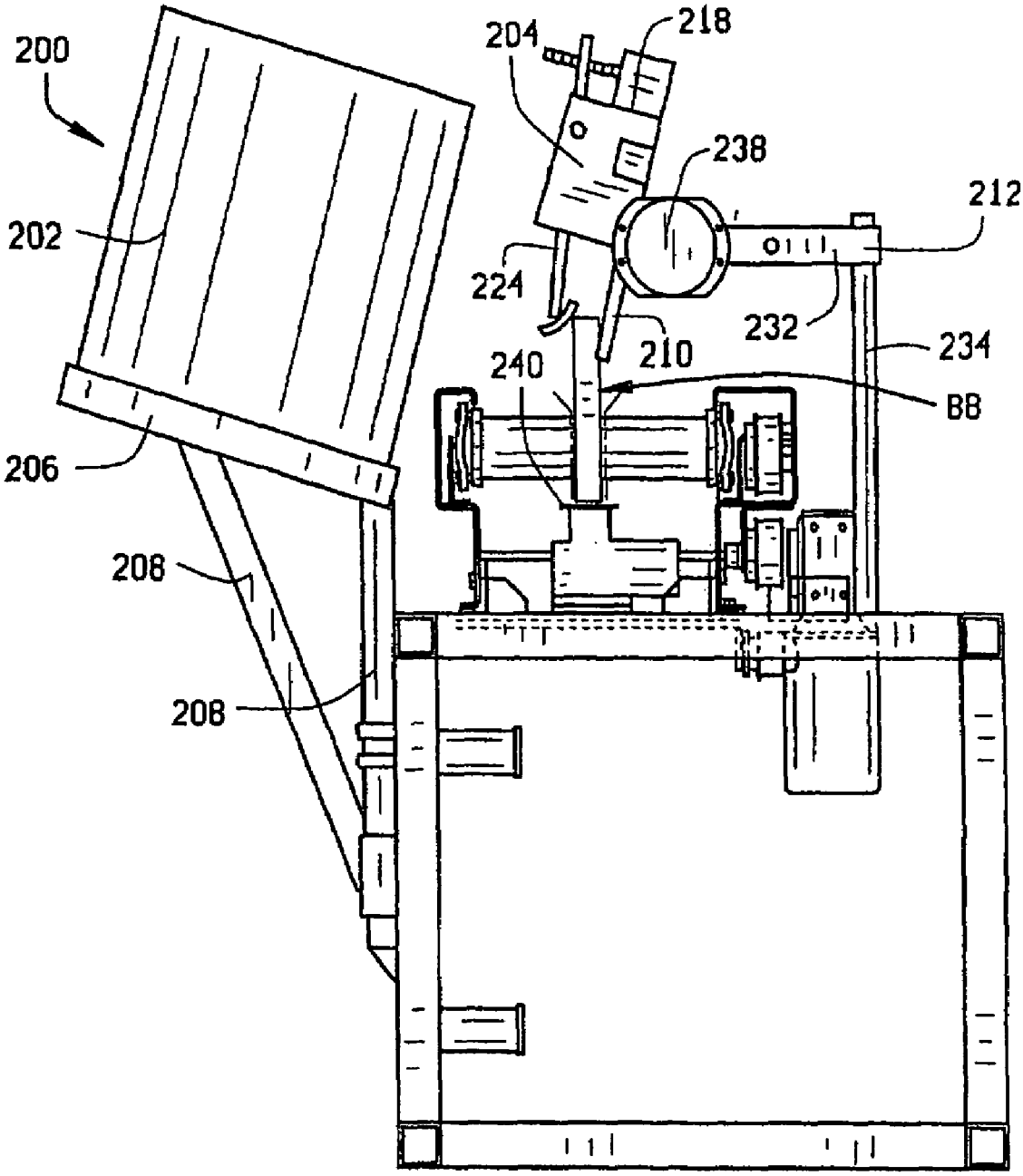
FIG. 23 is a view similar to that of FIG. 22 but showing the second, book page printer transfer mechanism in its ejection position loading a book block into the carriage of the printing and binding apparatus.
Figure 24:
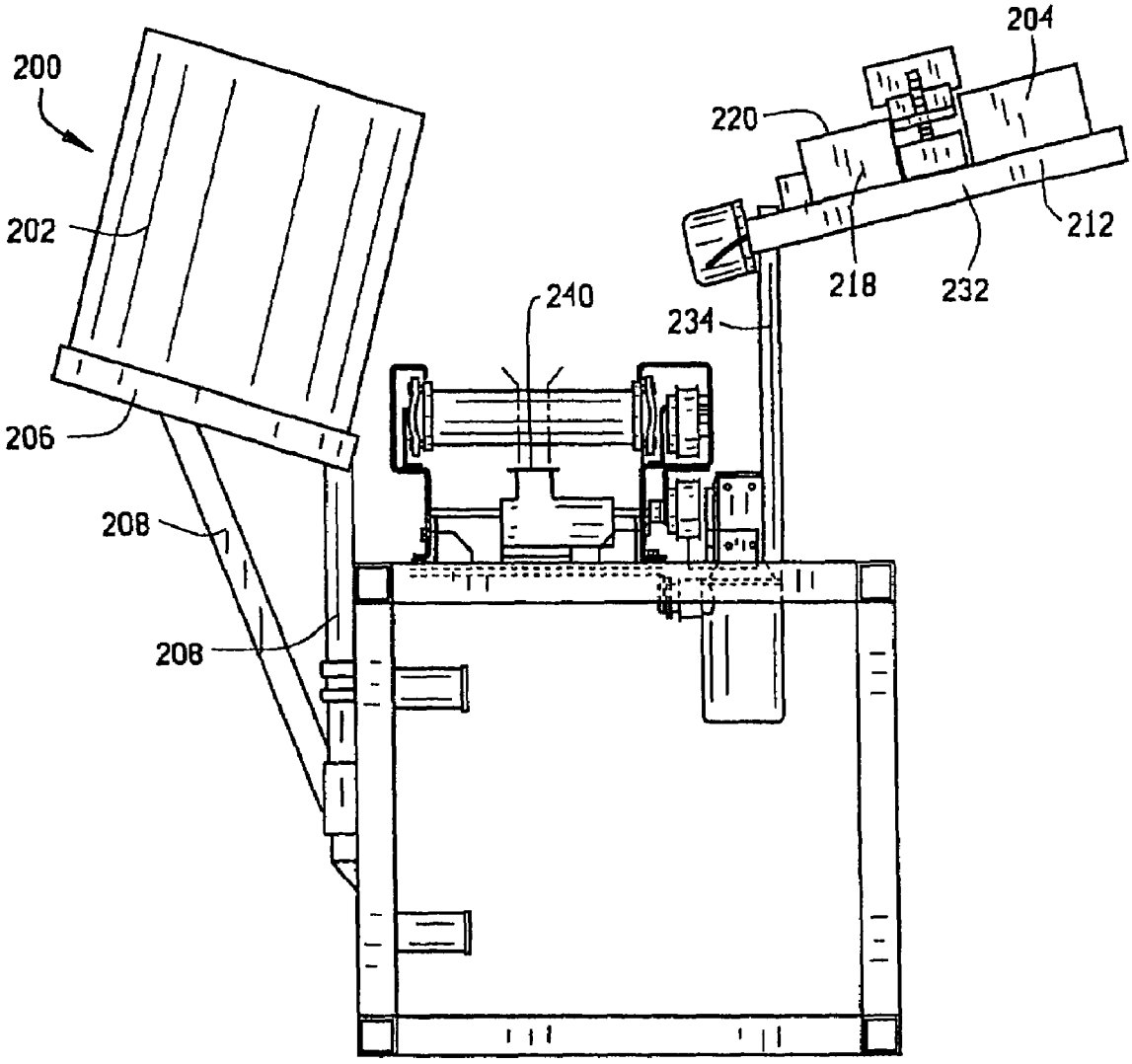
FIG. 24 is a view similar to that of FIG. 22 but showing the second book page printer transfer mechanism in the maintenance position.
Figure 25:
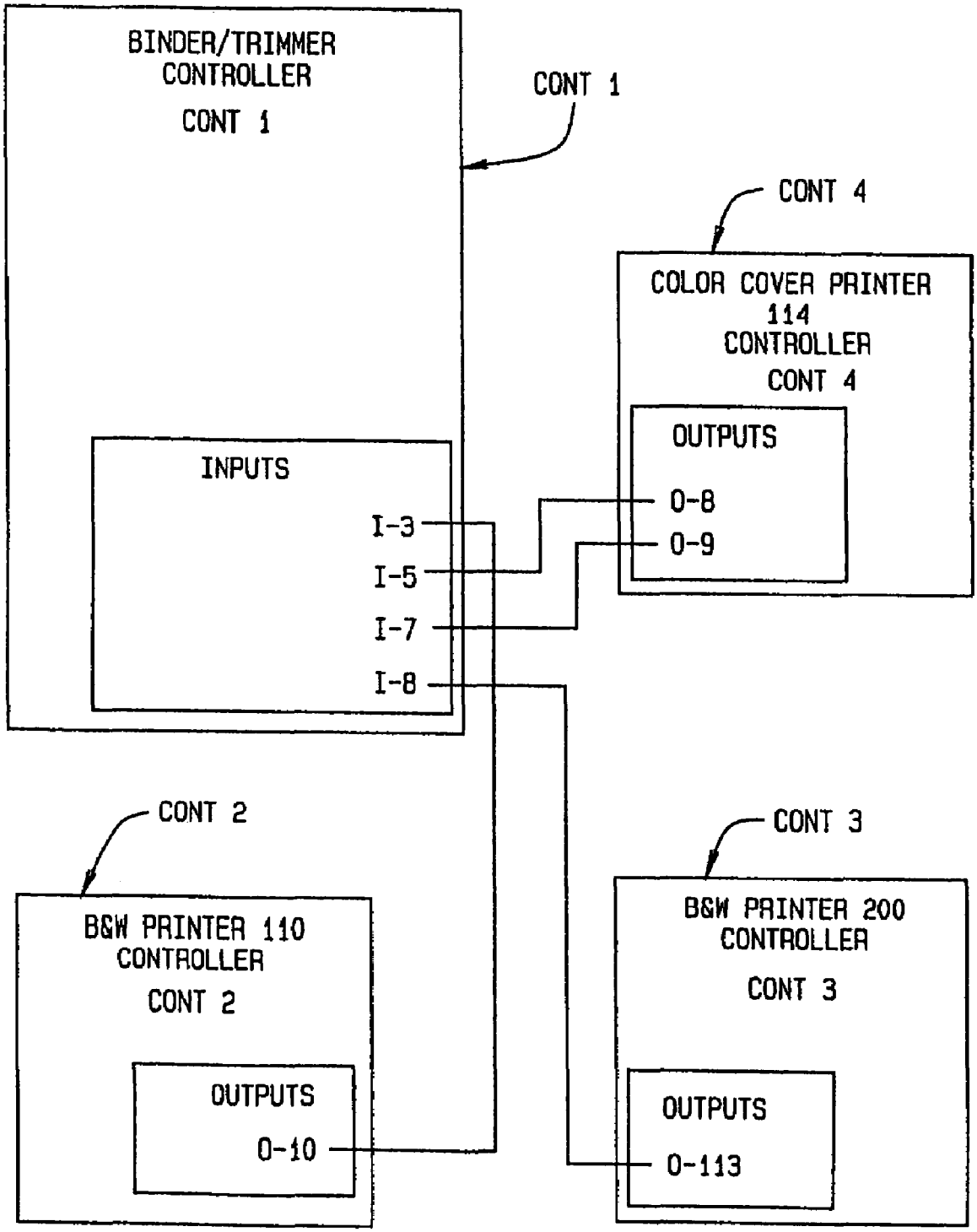
FIG. 25 is a block diagram of the control system for controlling operation of the apparatus of the present invention including control of two page or text printers and the color cover printer.

Unlike the transfer mechanism 112 of the first, book page printer assembly, the support bracket 212 of the second, transfer mechanism 204 is constructed with a C-shaped portion 232 of the bracket that supports the opposite ends of the tray shaft 226. The C-shaped portion 232 is mounted to the frame 3 of the printing and binding apparatus 1 for pivoting movement about a vertical axis defined by a main support member 234 of the support bracket. This pivoting connection allows the C-shaped portion 232 of the bracket 212, along with the tray 210 mounted thereto, to swing between an operational position, as shown in FIG. 21-23, and a maintenance position, as shown in FIG. 24. In the maintenance position the transfer mechanism 204 is easily accessed for servicing and the trimming station TM beneath the transfer mechanism is also more easily accessed for servicing. A locking mechanism 236 is provided for releasably securing the C-shaped portion 232 of the bracket 212 in the operational position.

Due to the pivoting movement of the tray 210 and the C-shaped portion 232 of the support bracket 212 with respect to the printing and binding apparatus 1, the rotation of the tray shaft 226 with respect to the C-shaped portion of the support bracket is driven by an alternating current tray shaft drive motor 238 that is mounted directly to the C-shaped portion of the support bracket such that it can pivot therewith. When the C-shaped portion 232 of the support bracket 212 is in the operational position, the tray shaft drive motor 238 can be operated by the control system CONT 1 to selectively rotate the shaft, together with the tray 210, between a printed page receiving position shown in FIG. 22 and a book block depositing position shown in FIG. 23.

In operation, the transfer mechanism 204 of the second, book page printer assembly 200 operates in a similar manner to the transfer mechanism 112 of the first, book page printer assembly. Thus, the transfer mechanism 204 receives pages from the printer 202 of the second, book page printer assembly 200 with the tray 210 in the printed page receiving position, initially jogs and collates the printed pages of a book block, clamps the printed book block on the tray, rotates the tray to its book block depositing position, and releases the book block to allow the book block to fall into the carriage 7, in the same manner as described above in reference to the first, book page printer assembly.

Unlike the transfer mechanism 112 of the first, book page printer assembly, the transfer mechanism 204 of the second, book page printer assembly rotates the tray 210 to its book block depositing position and releases the book block into the carriage 7 when the carriage is at the opposite end of the workpath WP, adjacent the trimming station TS. Just prior to this point, the carriage 7 will have deposited a bound book into the nest 41 of the trimming station TS and the carriage is therefore empty. Under the control of controller CONT 1, the carriage is moved beyond trimming station TS to a position below transfer mechanism 204 to receive the book block printed by the second printer 200. Then, after the book block is received in the carriage, the carriage is returned to the opposite end of the workpath WP so as to convey the second book block to the jogging station JS, to the milling station MS, to the adhesive application station AS, to the binding station BS, and thence to the trimming station TS in a manner similar to that described in regard to the book block printed by the first printer 110. Of course, while these operations are being carried out on the second book block, printer 110 may be printing another book block.

A horizontal positioning plate 240 is mounted to the printer binding apparatus 1 in a position aligned with the tray of the second transfer mechanism 204 and just beneath the carriage 7 when the carriage is positioned beneath the transfer mechanism 204 of the second, book page printer assembly 200 as shown in FIGS. 22-24. When a book block is deposited into the carriage 7 from the transfer mechanism 204 of the second, book page printer assembly 200, the spine of the book block is supported on the positioning plate 240 and then the clamping members 11*a*, 11*b* of the carriage 7 are moved together to firmly hold the book block. The positioning plate can also be provided with vertically extending sides positioned outside and below the clamping members 11*a*, 11*b* of the carriage 7 to prevent pages of the book block from slipping off of the positioning plate. The positioning plate 240 is at an elevation above that of the horizontal plate 13 of the jogging station JS such that a book block deposited into the carriage 7 by the second, book page printer assembly 200 is positioned higher in the carriage than a book block deposited into the carriage by the first, book page printer assembly. Thus, the positioning plate 240 serves to establish the vertical orientation of the book block as the book block is moved by the carriage 7 back along the workpath WP to the jogging station JS at the opposite end of the workpath. Positioning the book block higher in the carriage 7 prevents the book block from contacting any components of the various work stations as it is brought to the jogging station JS.

Once the carriage 7 arrives at the jogging station JS with the book block printed by the second, book page printer assembly 200, the clamping members 11*a*, 11*b* of the carriage 7 are released to allow the book block to drop onto the horizontal surface 13 of the jogging station JS. From this point, the pages of the book block are jogged and the book binding process proceeds in the same manner as it would if printed by the first book page printer assembly as described above.

Thus, by incorporating the second, book page printer assembly 200 in the additional embodiment of the printing and binding apparatus of the invention, the production rate of perfect bound books can be increased by alternating the feeding of the carriage with a book block printed by either of the first and second, book page printer assemblies. The increased production rate should be apparent in situations where the printing of a book block requires more time than it takes the carriage 7 to move along the work path from the jogging station JS to the opposite end of the work path and then return to the jogging station during the production of a perfect bound book. This is often the case when the books being bound have large numbers of pages. Incorporating the second, book page printer assembly 200 in the additional embodiment of the printing and binding apparatus also allows the printing and binding apparatus to continue production of perfect bound books when either of the printers of the first and second, book page printer assemblies is being serviced.

As mentioned above, the second, book page printer assembly 200 is positioned adjacent the trimming station TS which periodically requires maintenance. To perform such maintenance, it is helpful to have access to the trimming station TS from above. This is why the C-shaped portion 232 of the support bracket 212 is pivotable about the main support member 234 of the support bracket between the operational position and the maintenance position. As best shown in FIG. 21, the main support member 234 of the support bracket 212 is positioned adjacent the rear and right side of the C-shaped bracket 232. By releasing the locking mechanism 236, the C-shaped portion 232 of the support bracket 212 and the tray 210 can be pivoted about the main support member 234 into the maintenance position as shown in FIG. 24. With the C-shaped portion 232 of the support bracket 212 and the tray 210 in the maintenance position, the top of the trimming station TS can be easily accessed for maintenance. Finally, when such maintenance is complete, the C-shaped portion 232 of the support bracket 212 and the tray 210 can be quickly pivoted back into the operational position and the printing and binding apparatus returned to production.

As noted, the binding and trimming apparatus 1, as shown in FIGS. 1-9, is controlled by a programmable controller CONT 1. CONT 1 is preferably a programmable controller, such as an AT6400 controller, as described in the aforementioned U.S. Pat. No. 6,193,458 and as illustrated in FIG. 12 thereof. The controller CONT 1 for the printing, binding and trimming apparatus, as shown in FIGS. 14-25, in turn controls operation of the black and white printer 110 via a controller CONT 2 and of operation of black and white printer 200 via a controller CONT 3. Operation of color printer 114 is controlled by a fourth controller CONT 4. For example, controllers CONT 2-4 may be model RPC-150 programmable controllers commercially available from Remote Processing Corporation, 7975 E. Harvard Avenue, Denver, Colo. 80231.

As previously noted, the apparatus of this invention is intended for printing, binding and trimming perfect bound books on demand. That is, such on demand printed books are stored in a digital library in a variety of digital formats. For example, the text pages of the books may be scanned and stored in a bit mapped format, or they stored in a PDF or other widely used format. The covers for the books are also stored in the digital library. Such covers may also be stored in a variety of formats. The digital library is typically stored on a so-called book server computer (not shown) and may be controlled by a book director computer program, the essential details of which are disclosed below. As described in the above-noted U.S. Pat. 5,465,213, the book server may be located proximate the apparatus of this invention or may be located remotely and connected over a wide area network, such as the Internet. Persons may access the system to order a book to be printed on demand in a variety of ways. One preferred way would be to allow an Internet connection such that a customer could access the book server remotely, view the books in the digital library, and upon choosing a book, ordering the book and commanding the apparatus of the present invention to print, bind and trim the selected book.

The control logic for operating a printing, binder, trimmer apparatus, as shown in FIG. 21, will be understood by one of ordinary skill in the art from the following listing of the basic programming steps:

1. CONT 1 determines the number of book block printers 110 or 200 running on the machine.
2. CONT 1 signals (by placing a control file) the book director program on a book server, which black and white book block printer 110 or 200 is ready for a book block file (i.e., the text pages) and if two printers are present, toggles a logical variable to signal the book director program to the second printer for the next book. (And then back to the first printer for the following book and so on.)
3. The book director program sends a pre-defined book "package" consisting of a book block printing script or text with the printer designated by 2 to the print spooler of the selected printer 110 or 200, a cover printing script with the cover printer 114 designated to the print spooler and a control file containing the book finish parameters (e.g., number of pages, paper thickness, any vertical offset between the cover and the book block, and finish trim dimensions).
4. CONT 1, having determined which black and white book block printer is to receive the next book block, positions the carriage 7 proximate to and monitors port #23 of that printer 110, 200 via a tcp/ip connection for a job complete message at that port.

5. Upon receiving the job complete message at the monitored port, controller CONT 1 moves the carriage 7 fully into position at a respective printer 110, 200 to receive the book block BB. As the carriage moves into position, a switch is closed causing the book block tray controller associated with that printer to clamp rotate and then release the book block into the carriage. Upon releasing the book block, the book block tray controller notifies CONT 1 that the block is in place.
6. As the cover exits cover printer 114, a signal is generated to signal the cover controller CONT 4 that the cover is within cover transport mechanism 116 and the cover controller is then able to deliver the printed cover to the binding station BS.
7. CONT 1 then monitors the cover printer transfer controller CONT 4 for a signal that it has placed the cover into place in the binder station BS.
8. Upon notification that a book block BB is in place within carriage 7 and that the cover is in place at the binding station BS, CONT 1 then moves carriage 7 to the jogging station JS and reads the control file sent in 3.
9. Using the dimensions T1-T5 incorporated in the control file, as above described, the trim margins TM1-TM3 are determined.
10. The desired position of the cover C at the binding station BS are then determined such that that cover is centered with respect to book block spine S. The cover may be centered with respect to the spine S of the book block BB by energizing stepper motor M1100 to drive rolls 186 if forward or rearward direction so as to accurately located the portion of cover C which is to be bound to spine S of its respective book block. It will also be understood that the cover may be located with respect to the spine of its book block by, upon printing of the cover, centering the material printed on the cover with respect to the cover stock. In this manner, the cover may be accurately positioned by bringing the leading edge of the cover C into engagement with a fixed stop.
11. With carriage 7 positioned at jogging station JS, the jogging station is energized and deenergized for a time sufficient to jog or vibrate pages P (about 1-3 seconds) so as to align the pages of the book block.
12. During the jogging operation, the trailing edge of book block BB is insured to be in contact with vertical carriage wall 21 thus accurately establishing the fore to aft position of the book block in carriage 7.
13. With the book block BB properly positioned within the carriage, carriage clamp motor M2 is energized so as to close carriage clamps 11*a*, 11*b*.
14. Wait 5 seconds, and then energize motors M3-M5.
15. Energize Carriage Stepper Motor M1 to drive carriage 7 from Jogging Station JS to Mill Station MS. As the carriage approaches Mill Station MS, the mill head 31 is energized so as to roughen the spine of the book block as the latter is conveyed past the mill station.
16. As the book block BB is conveyed over adhesive application station AS, the spine of the book block has a suitable amount of hot melt adhesive applied thereto.
17. Deenergize Carriage Stepper motor M1 so as to stop carriage 7 at binding station BS with book block BB positioned over center CP of cover C.
18. Energize pump PM4 to raise binding clamp 35.
19. Energize clamp motor M6 to clamp cover on book block. This clamp is maintained for a time sufficient for the setting of adhesive A to bind the spine of the book block BB to the inner surface of the conditioned cover C.
20. Energize clamp motor M6 to release book.
21. Reverse operation of pump PM4 to lower binding clamp 35.
22. Energize carriage stepper motor M1 to convey carriage from binding station BS to trim station TS.
23. Energize nest elevator motor M6 to raise nest elevator.
24. Energize carriage clamp motor M2 to drop book.
25. Energize carriage stepper motor M1 to nudge book to predetermined position within nest 41 such that first edge of book is accurately position with respect to nest 41.
26. Energize pump PM3 to actuate nest clamp 57.
27. Energize nest elevator stepper motor to lower nest to predetermined elevation.
28. Energize trim carriage 61 stepper motor M9 to move trimmer 59 toward first edge of book to be trimmed (T3).
29. Deenergize motor M9 to stop trimmer 59 so as to trim first trim margin TM1 from book.
30. Energize Pump PM2 to close shear clamp 67.
31. Energize Pump PM1 to close trimmer blade 64.
32. Reverse operation of Pump PM1 to open trimmer blade 64.
33. Reverse operation of Pump PM 2 to open shear clamp 67.
34. Energize trimmer carriage stepper motor M9 to move trimmer carriage clear of book.
35. Energize book indexing stepper motor M9 to rotate book in nest 90° so as to position a second edge of book to be trimmed.
36. Energize trim carriage 61 stepper motor M9 to move trimmer 59 toward second edge of book to be trimmed.
37. Deenergize motor M9 to stop trimmer 59 so as to trim second trim margin TM1 from book.
38. Energize Pump PM2 to close shear clamp 67.
39. Energize Pump PM1 to close trimmer blade and to trim second edge.
40. Reverse operation of Pump PM1 to open trimmer blade 63.
41. Reverse operation of Pump PM 2 to open shear clamp 67.
42. Energize trimmer carriage stepper motor M9 to move trimmer carriage clear of book.
43. Energize book indexing stepper motor M9 to rotate book in nest 41 90° so as to orient third edge of book to be trimmed toward trimmer.
44. Energize trim carriage 61 stepper motor M9 to move trimmer 59 toward third edge of book to be trimmed.
45. Deenergize motor M9 to stop trimmer 59 so as to trim third trim margin TM1 from book so as to trim book to final height (T5).
46. Energize Pump PM2 to close shear clamp 67.
47. Energize Pump PM1 to close trimmer blade and to trim third edge.
48. Reverse operation of Pump PM1 to open trimmer blade.
49. Reverse operation of Pump PM 2 to open shear clamp 67.
50. Energize trimmer carriage stepper motor M9 to move trimmer carriage clear of book
51. Energize Pump PM to open book clamp 57 and to release book.
52. Upon CONT 1 determining that the book block for the first book to be printed has been loaded into the carriage, CONT 1 may signal the book director program that printer 110 is ready to receive another book "package"

such that the text pages of a third book may be sent to the print spool of printer 110. In this manner, printer 110 can begin printing the third book while printer 200 is still printing the text pages of the second book.

53. Likewise, upon CONT 1 determining that the book block for the second book to be printed has been loaded in the carriage, CONT 1 may signal the book director program that printer 200 is ready to receive another book "package" such that the text pages of a fourth book may be sent to the print spool of printer 200. In this manner, printer 200 may be printing the text pages of the fourth book while printer 110 is still printing the text pages of the third book.

The above steps complete the printing of the book block BB and of the cover C, the laminating of the cover C, the binding of the book block to the double laminated cover C, and the trimming of a first book. It will be understood that while the first book is being so printed, laminated, bound and trimmed, a second book may be substantially simultaneously be printed by the second text printer 200. Depending on the number of pages in the books being printed, the printing of the text pages of the book block typically determines the length of time necessary to print and bind a book with the apparatus of this invention. Thus, by providing two text page printers, the throughput of the apparatus can be significantly increased.

A program listing for the computer program for controller controllers CONT1, CONT 2, CONT 3, and CONT 4 is set out below. This program is in Visual Basic language and reflects the code for controlling operation of the apparatus disclosed herein as of the filing date of the present application in the attached Appendix being filed herewith and herewith incorporated by reference.

While the disclosure herein describes the use of sheet fed text page printers 110 and 200, it will be understood that in certain applications web fed printers may be used. In such case, after the text pages are printed on a web of paper, the text pages are cut from the web and are accumulated so as to form the book blocks BB, as above described, and then the books are bound and trimmed in the manner described.

While the present invention has been described by reference to specific embodiments, it should be understood that modifications and variations of the invention may be constructed without departing from the scope of the invention defined in the following claims.

What is claimed is:

1. Apparatus for on demand printing and binding a book, the latter comprising a cover and a book block having a plurality of pages with one edge of said book block constituting a spine, said apparatus comprising:

a page printer for printing the pages of said book, wherein said page printer prints said pages using an electronic file corresponding to said book to be on demand printed;

an accumulator receiving said pages of said book printed by said page printer;

a first clamp gripping said book block with said spine exposed;

an adhesive applicator applying an adhesive so as to be disposed between a portion of said cover and said spine of said book block as said cover and said book block are brought together so as to bind the cover to the book block;

a second clamp engageable with said cover so as to clamp said cover to said book block adjacent said spine thereby to effect the adhesive binding of said cover to said book block; and said accumulator including an accumulator clamp for holding said pages.

2. Apparatus as set forth in claim 1 wherein said adhesive applicator applies adhesive to said cover so as to be in register with said spine when said cover is in position to be bound to said book block.

3. Apparatus as set forth in claim 1 further comprising a trimmer for trimming margins from said book after the book has been bound.

4. Apparatus as set forth in claim 3 wherein a binding station binds together said book block and said cover so as to form a bound book, and wherein said apparatus further comprises a conveyor so as to transfer said bound book from said binding station to said trimmer with said bound book being positioned in a predetermined location with respect to said trimmer so that upon actuation of said trimmer, said margins may be trimmed from said bound book thereby to result in a trimmed book of predetermined dimensions.

5. Apparatus as set forth in claim 1 further comprises a cover printer, wherein said cover printer prints said cover using said electronic file corresponding to said book to be on demand printed, and a conveyor for conveying said cover to a binding station where said second clamp clamps said cover to said book block.

6. Apparatus as set forth in claim 1 wherein said adhesive applicator applies adhesive to said spine of said book block so as to be in register with a predetermined portion of said cover when said cover is in position to be bound to said book block.

7. Apparatus for on demand printing and binding a book, the latter comprising a book block having a plurality of pages with one edge of said book block constituting a spine, said apparatus comprising:

a page printer for printing the pages of said book;

an accumulator receiving said pages of said book printed by said page printer, wherein said accumulator comprises an accumulator clamp for holding said pages;

a cover printer for printing said cover for said book;

a first clamp gripping said book block with said spine exposed;

an adhesive applicator applying an adhesive so as to be disposed between a portion of said cover and said spine of said book block as said cover and said book block are brought together so as to bind the cover to the book block; and a second clamp engageable with said cover so as to clamp said cover to said book block adjacent said spine thereby to effect the adhesive binding of said cover to said book block.

8. Apparatus for on demand printing and binding a book, the latter comprising a cover and a book block having a plurality of pages with one edge of said book block constituting a spine, said apparatus comprising:

a page printer for printing the pages of said book, wherein said page printer prints said pages using an electronic file corresponding to said book to be on demand printed;

an accumulator receiving said pages of said book printed by said page printer;

a first clamp gripping said book block with said spine exposed;

an adhesive applicator applying an adhesive so as to be disposed between a portion of said cover and said spine of said book block as said cover and said book block are brought together so as to bind the cover to the book block, wherein said adhesive applicator applies adhesive to said cover so as to be in register with said spine when said cover is in position to be bound to said book block; and a second clamp engageable with said cover so as to clamp said cover to said book block adjacent said spine thereby to effect the adhesive binding of said cover to said book block.

9. Apparatus set forth in claim 8 further comprising a trimmer for trimming margins from said book after the book has been bound.

10. Apparatus as set forth in claim 9 wherein a binding station binds together said book block and said cover so as to form a bound book, and wherein said apparatus further comprises a conveyor so as to transfer said bound book from said binding station to said trimmer with said bound book being positioned in a predetermined location with respect to said trimmer so that upon actuation of said trimmer, said margins may be trimmed from said bound book thereby to result in a trimmed book of predetermined dimensions.

11. Apparatus set forth in claim 8 further comprising a cover printer, wherein said cover printer prints said cover using said electronic file corresponding to said book to be on demand printed, and a conveyor for conveying said cover to a binding station where said second clamp clamps said cover to said book block.

* * * * *